US009489962B2

(12) United States Patent
Chong et al.

(10) Patent No.: US 9,489,962 B2
(45) Date of Patent: Nov. 8, 2016

(54) SOUND SIGNAL HYBRID ENCODER, SOUND SIGNAL HYBRID DECODER, SOUND SIGNAL ENCODING METHOD, AND SOUND SIGNAL DECODING METHOD

(71) Applicant: Panasonic Corporation, Osaka (JP)

(72) Inventors: Kok Seng Chong, Singapore (SG); Takeshi Norimatsu, Hyogo (JP)

(73) Assignee: PANASONIC CORPORATION, Osaka (JP)

( * ) Notice: Subject to any disclaimer, the term of this patent is extended or adjusted under 35 U.S.C. 154(b) by 125 days.

(21) Appl. No.: 14/117,738

(22) PCT Filed: May 8, 2013

(86) PCT No.: PCT/JP2013/002950
§ 371 (c)(1),
(2) Date: Nov. 14, 2013

(87) PCT Pub. No.: WO2013/168414
PCT Pub. Date: Nov. 14, 2013

(65) Prior Publication Data

US 2014/0074489 A1 Mar. 13, 2014

(30) Foreign Application Priority Data

May 11, 2012 (JP) ..... 2012-108999

(51) Int. Cl.
*G10L 19/00* (2013.01)
*G10L 19/04* (2013.01)
(Continued)

(52) U.S. Cl.
CPC ..... *G10L 19/04* (2013.01); *G10L 19/20* (2013.01); *G10L 19/0212* (2013.01); *G10L 19/06* (2013.01); *G10L 19/22* (2013.01)

(58) Field of Classification Search
CPC ..... G10L 19/20; G10L 19/22; G10L 19/24; G10L 19/0017; G10L 19/008; G10L 19/06; G10L 19/08; H03M 7/40; H03M 7/46; H04N 19/10; H04N 19/61
USPC ..... 704/219, 500, 262, 229, 206; 381/23; 375/259; 370/352; 341/63
See application file for complete search history.

(56) References Cited

U.S. PATENT DOCUMENTS 4,949,383 A * 8/1990 Koh ..... H04B 1/667 704/224
6,124,811 A * 9/2000 Acharya ..... H03M 7/40 341/63

(Continued)

FOREIGN PATENT DOCUMENTS

DE WO 2011048118 A1 * 4/2011 ..... G10L 19/0212
WO 2010/148516 12/2010

(Continued)

OTHER PUBLICATIONS

Neuendorf et al, "Completion of Core Experiment on unification of USAC Windowing and Frame Transitions", Jan. 2010, MPEG2010-ISO VoiceAge Corp, MPEG 2010, M17167, all pages.*

(Continued)

*Primary Examiner* — Michael Colucci
(74) *Attorney, Agent, or Firm* — Wenderoth, Lind & Ponack, L.L.P.

(57) ABSTRACT

A sound signal hybrid encoder includes: a signal analysis unit which determines a scheme for encoding a frame included in a sound signal; an LFD encoder which encodes a frame to generate an LFD frame; an LP encoder which encodes a frame to generate an LP frame; a switching unit which switches between the encoders according to a result of the determination by the signal analysis unit; and an AC signal generation unit which generates an AC signal according to a scheme selected from among schemes, outputs the generated AC signal, and also outputs an AC flag indicating the selected scheme.

19 Claims, 12 Drawing Sheets

(51) Int. Cl.

| | |
|---|---|
| ***G10L 19/20*** | (2013.01) |
| *G10L 19/22* | (2013.01) |
| *G10L 19/02* | (2013.01) |
| *G10L 19/06* | (2013.01) |

(56) References Cited

U.S. PATENT DOCUMENTS

| | | | | |
|---|---|---|---|---|
| 6,426,977 | B1 * | 7/2002 | Lee | H04K 1/00 375/259 |
| 8,804,970 | B2 * | 8/2014 | Grill | H04R 5/00 381/1 |
| 2002/0173967 | A1 * | 11/2002 | Law | G10L 19/0212 704/500 |
| 2010/0121646 | A1 * | 5/2010 | Ragot | G10L 19/0204 704/500 |
| 2010/0157984 | A1 * | 6/2010 | Hwang | H04L 12/66 370/352 |
| 2010/0217606 | A1 * | 8/2010 | Osada | H04B 1/662 704/500 |
| 2010/0241433 | A1 * | 9/2010 | Herre | G10L 19/22 704/500 |
| 2010/0292994 | A1 * | 11/2010 | Lee | G10L 19/008 704/500 |
| 2011/0153333 | A1 | 6/2011 | Bessette | |
| 2011/0238426 | A1 * | 9/2011 | Fuchs | G10L 19/0017 704/500 |
| 2011/0320196 | A1 * | 12/2011 | Choo | G10L 19/12 704/229 |
| 2012/0101813 | A1 * | 4/2012 | Vaillancourt | G10L 19/20 704/206 |
| 2012/0226496 | A1 * | 9/2012 | Yoon | G10L 19/06 704/219 |
| 2012/0265541 | A1 | 10/2012 | Geiger et al. | |
| 2012/0271644 | A1 * | 10/2012 | Bessette | G10L 19/03 704/500 |
| 2013/0090929 | A1 * | 4/2013 | Ishikawa | G10L 19/0212 704/262 |
| 2013/0289981 | A1 * | 10/2013 | Ragot | G10L 19/022 704/219 |

FOREIGN PATENT DOCUMENTS

| | | | | |
|---|---|---|---|---|
| WO | 2011/013980 | 2/2011 | | |
| WO | 2011/034374 | 3/2011 | | |
| WO | 2011/048118 | 4/2011 | | |
| WO | WO 2011/048118 A1 * | 4/2011 | | G10L 19/02 |
| WO | 2011/158485 | 12/2011 | | |

OTHER PUBLICATIONS

Neuendorf et al, "Completion of Core Experiment on unification of USAC Windowing and Frame Transitions", Jan. 2010, MPEG2010-ISO VoiceAge Corp, MPEG 2010, MI 7167, all pages.*

Extended European Search Report issued Mar. 25, 2015 in corresponding European Application No. 13786609.1.

Max Neuendorf et al., "Completion of Core Experiment on unification of USAC Windowing and Frame Transitions", 91. MPEG Meeting, Jan. 18, 2010-Jan. 22, 2010, Kyoto, Japan, (Motion Picture Expert Group or ISO/IEC JTC1/SC29/WG11), No. M17167, Jan. 16, 2010, XP030045757.

International Search Report issued Jun. 4, 2013 in corresponding International Application No. PCT/JP2013/002950.

Carot, Alexander et al., "Networked Music Performance: State of the Art", AES 30th International Conference, Mar. 15-17, 2007.

Schuller, Gerald et al., "New Framework for Modulated Perfect Reconstruction Filter Banks", IEEE Transaction on Signal Processing, vol. 44, pp. 1941-1954, Aug. 1996.

Schnell, Markus, et al, "MPEG-4 Enhanced Low Delay AAC—a new standard for high quality communication", AES 125th Convention, Oct. 2-5, 2008.

Valin, Jean-Marc, et al., "A Full-bandwidth Audio Codec with Low Complexity and Very Low Delay" 17$^{th}$ European Signal Processing Conference (EUSIPCO 2009), Aug. 24-28, 2009.

Office Action issued Jun. 22, 2016 in Chinese Patent Application No. 201380001328.9, with English translation of Search Report.

* cited by examiner

SOUND SIGNAL HYBRID ENCODER, SOUND SIGNAL HYBRID DECODER, SOUND SIGNAL ENCODING METHOD, AND SOUND SIGNAL DECODING METHOD

TECHNICAL FIELD

The present invention relates to a sound signal hybrid encoder and a sound signal hybrid decoder capable of codec-switching.

BACKGROUND ART

A hybrid codec has the advantages of both an audio codec and a speech codec. The hybrid codec can code a sound signal that is a mixture of content mainly including a speech signal and content mainly including an audio signal, by switching between the audio codec and the speech codec. With this switching, coding is performed according to a coding method suitable for each type of content. Thus, the hybrid codec implements a stable compression coding for a sound signal at a low bit rate.

Moreover, it is known that the hybrid codec generates an aliasing cancellation (AC) signal at the encoder side in order to reduce aliasing caused in the case of codec switching.

CITATION LIST

Non Patent Literature

[NPL 1]
Carot, Alexander et al., "Networked Music Performance: State of the Art", AES 30th International Conference (Mar. 15 to 17, 2007).
[NPL 2]
Schuller, Gerald et al., "New Framework for Modulated Perfect Reconstruction Filter Banks", IEEE Transaction on Signal Processing, Vol, 44, pp, 1941-1954 (August, 1996).
[NPL 3]
Schnell, Markus, et al, "MPEG-4 Enhanced Low Delay AAC—a new standard for high quality communication", AES 125th Convention (Oct. 2 to 5, 2008).
[NPL 4]
Valin, Jean-Marc, et al, "A Full-bandwidth Audio Codec with Low Complexity and Very Low Delay".

SUMMARY OF INVENTION

Technical Problem

The hybrid codec can efficiently encode content that includes both a speech signal and an audio signal. On this account, the hybrid codec can be used in various applications, such as an audio book, a broadcasting system, a portable media device, a mobile communication terminal (a smart phone or a tablet computer, for example), a video conferencing device, and a networked music performance.

However, particularly when the hybrid codec is used in an application, such as a video conferencing device or a networked music performance, where real time communication performance is important, an algorithmic delay caused in the encoding process and the decoding process is a major problem.

In order to reduce such an algorithmic delay, the size of a frame (the number of samples) may be reduced.

However, when the size of the frame is reduced, the frequency of frame switching is increased and this naturally results in an increased frequency of occurrence of the AC signal. In order to implement a low-bit-rate low-delay hybrid codec of high quality, it is preferable for the amount of coded data of the AC signal to be reduced. In other words, the challenge here is how to efficiently generate the AC signal.

Thus, the present invention provide a sound-signal hybrid encoder and so forth capable of efficiently generating an AC signal.

Solution to Problem

A sound-signal hybrid encoder in an aspect according to the present invention is a sound signal hybrid encoder including: a signal analysis unit which analyzes characteristics of a sound signal to determine a scheme for encoding a frame included in the sound signal; a lapped frequency domain (LFD) encoder which encodes a frame included in the sound signal by performing an LFD transform on the frame, to generate an LFD frame; a linear prediction (LP) encoder which encodes a frame included in the sound signal by calculating and using linear prediction coefficients of the frame, to generate an LP frame; a switching unit which switches, for frame encoding, between the LFD encoder and the LP encoder, according to a result of the determination by the signal analysis unit; a local decoder which generates a locally-decoded signal including (1) a signal obtained by decoding at least a part of an aliasing cancellation (AC) target frame that is the LFD frame adjacent to the LP frame according to switching control by the switching unit and (2) a signal obtained by decoding at least a part of the LP frame adjacent to the AC target frame; and an AC signal generation unit which generates, using the sound signal and the locally-decoded signal, an AC signal used for cancelling aliasing caused when the AC target frame is decoded, and outputs the generated AC signal, wherein, when the AC target frame is immediately after the LP frame or when the AC target frame is immediately before the LP frame, the AC signal generation unit (1) generates the AC signal according to a scheme selected from among a plurality of schemes and outputs the generated AC signal and (2) outputs an AC flag indicating the selected scheme.

These general and specific aspects may be implemented using a system, a method, an integrated circuit, a computer program, or a computer-readable recording medium such as a CD-ROM, or any combination of systems, methods, integrated circuits, computer programs, or computer-readable recording media.

Advantageous Effects of Invention

The sound-signal hybrid encoder according to the present invention is capable of efficiently generating an AC signal.

DESCRIPTION OF EMBODIMENTS

Figure 1:
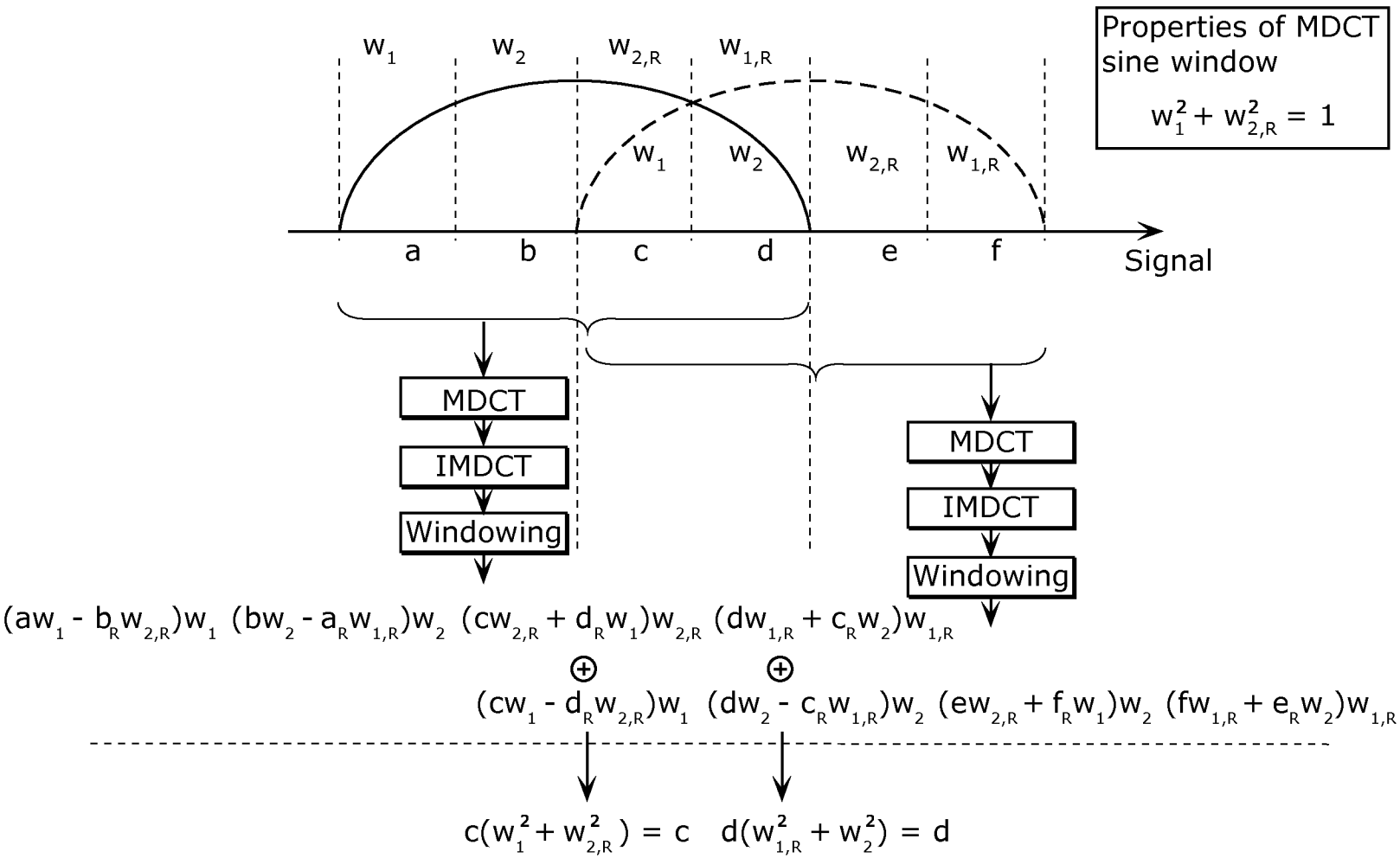
FIG. 1 is a diagram explaining about cancellation of aliasing caused by a partial overlap between coding and decoding based on a modified discrete cosine transform (MDCT).

[Underlying Knowledge Forming Basis of the Present Invention]

The conventional sound compression technology is broadly categorized into two groups: a group of audio codecs and a group of speech codecs.

An audio codec is firstly described.

The audio codec is suitable for coding a stationary signal including local spectral content (such as a tone signal or a harmonic signal). The audio codec performs coding mainly by transforming the signal into the frequency domain.

To be more specific, the encoder of the audio codec transforms an input signal into the frequency (spectral) domain based on a time-frequency domain transform such as a modified discrete cosine transform (MDCT). When the MDCT is performed, a frame to be coded has a part that temporally overlaps (a partial overlap) with a contiguous (adjacent) frame, and windowing is performed on each frame to be coded. The partial overlap is used at the decoder side for smoothing the boundary between the frames.

Windowing serves the dual purpose of generating a higher resolution spectrum and attenuating the boundary between the coded frames for the aforementioned smoothing. In order to compensate for the sampling effect caused by the partial overlap, the time domain samples are transformed by the MDCT into a reduced number of spectral coefficients for coding. Although the time-frequency domain transform such as the MDCT causes an aliasing component, the partial overlap allows the aliasing component to be cancelled at the decoder.

One of the major advantages of the audio codec is that a psychoacoustic model can be easily used. For example, a larger number of bits can be assigned to a perceptual "masker", and a smaller number of bits can be assigned to a perceptual "maskee" that the human ear cannot perceive. By using the psychoacoustic model, the audio codec significantly improves the coding efficiency and the sound quality. The moving picture experts group (MPEG) advanced audio coding (AAC) is one good example of a pure audio codec.

Next, a speech codec is described.

The speech codec uses a model-based method that employs the pitch characteristics of the human vocal tract, and thus is suitable for coding human speech. The encoder of the speech codec uses a linear prediction (LP) filter to obtain a spectral envelop of human speech, and codes coefficients of the LP filter of an input signal.

After this, the LP filter performs inverse filtering (i.e., spectrally separates) the input signal to generate a spectrally-flat excitation signal. The excitation signal referred to here represents an excitation signal including a "code word", and is usually sparsely coded according to a vector quantization (VQ) method.

It should be noted that, aside from the LP filter, a long term predictor (LTP) may be included in order to obtain the long-term periodicity of speech. Moreover, a psychoacoustic aspect of coding can be considered by applying a whitening filter to the signal before the LP filter is applied.

The sparse coding of the excitation signal implements the excellent sound quality at a low bit rate. However, such a coding scheme cannot accurately obtain the complex spectrum of content such as music and, for this reason, the content such as music cannot be reproduced with a high sound quality. The Adaptive Multi-Rate Wideband (AMR-WB) by the International Telecommunication Union Telecommunication Standardization Sector (ITU-T) is one good example of a pure speech codec.

As a third codec, a coding scheme called "transform coded excitation (TCX)" is present. The TCX scheme is like a combination of LP coding and transform coding. The input signal is firstly perceptually weighted by a perceptual filter derived from the LP filter of the input signal. Next, the weighted input signal is then transformed into the spectral domain, and then the spectral coefficients are coded according to the VQ method. The TCX scheme can be found in an ITU-T Adaptive Multi-Rate Wideband Plus (AMR-WB+) codec. The frequency transform employed by the AMR-WB+ is a discrete Fourier transform (DFT).

Here, in order to implement coding at a lower bit rate, the aforementioned core coding schemes can be complemented by additional low-bit-rate tools. Two major low-bit-rate tools are a bandwidth extension tool and a multichannel extension tool.

The bandwidth extension (BWE) tool parametrically codes a high frequency part of the input signal on the basis of a harmonic relation between a low frequency part and the high frequency part. Examples of these BWE parameters include subband energies and tone-to-noise ratios (TNRs).

The decoder forms a basic high frequency signal by extending the low frequency part of the input signal either by patching or stretching the input signal. Next, the decoder uses the BWE parameters to form the amplitude of the spectrally extended signal. In other words, the BWE parameters compensate for the noise floor and the tone quality using artificially generated counterparts.

The resulting signal outputted from the decoder does not resemble the original input signal in waveform. However, the resulting signal is perceptually similar to the original signal. The MPEG High Efficiency AAC (HE-AAC) is a codec including such a BWE tool, code-named "spectral band replication (SBR)". According to SBR, parameter calculation is executed in a hybrid domain (time-frequency domain) generated by a quadrature mirror filter bank (QMF).

The multichannel extension tool downmixes multiple channels into a subset of channels for coding. The multichannel extension tool parametrically codes relations among the individual channels. Examples of these multichannel extension parameters include interchannel level differences, interchannel time differences, and interchannel correlations.

The decoder synthesizes a signal of each individual channel by mixing the decoded downmix channel signal with an artificially generated "decorrelated" signal. Here, according to the aforementioned parameters, a mixing weight of the downmix channel signal and the decorrelated signal is calculated.

The resulting signal outputted from the decoder does not resemble the original input signal in waveform. However, the resulting signal is perceptually similar to the original input signal. The MPEG Surround (MPS) is one good example of such a multichannel extension tool. As with SBR, MPS parameters are also calculated in the QMF domain. The multichannel extension tool is known as a stereo extension tool as well.

In this age of high definition (HD), communication devices are changing into general-purpose devices that respond to the needs of users in multimedia, entertainment, communications, and so forth. This results in an increase in demand for a unified codec that can process both the signal mainly including speech (i.e., the speech signal) and the signal mainly including audio (i.e., the audio signal).

In recent years, the unified speech and audio coding (USAC) has been standardized by MPEG. A USAC codec is a low-bit-rate codec that can code both a speech signal and an acoustic signal included in an input signal (the speech and audio signal) with a wide range of bit rates.

To be more specific, the USAC codec selects and combines the most appropriate tools from among all the aforementioned tools (the method similar to the AAC method (referred to as the "AAC" method hereafter), the LP scheme, the TCX scheme, the band extension tool (referred to as the SBR tool hereafter), and the channel extension tool (referred to as the MPS tool hereafter)).

The encoder of the USAC codec downmixes a stereo signal into a mono signal using the MPS tool, and reduces the full-range mono signal into a narrowband mono signal using the SBR tool. Moreover, in order to code the narrowband mono signal, the encoder of the USAC codec analyzes the characteristics of a signal frame using a signal classification unit and then determines which one of the core codecs (AAC, LP, and TCX) should be used for coding. Here, it is important for the USAC codec to cancel aliasing caused between the frames due to the codec switching.

As described above, in order to smooth the boundaries between the frames and cancel aliasing, the MDCT concatenates the consecutive frames and performs windowing on the concatenated signal before applying transform. This is illustrated in FIG. 1.

FIG. 1 is a diagram explaining about the cancellation of aliasing caused by the partial overlap between coding and decoding based on the MDCT.

In FIG. 1, "a" and "b" denote a first half of a frame 1 and a second half of the frame 1, respectively, in the case where the frame 1 is divided into two equal parts. Moreover, "c" and "d" denote a first half of a frame 2 and a second half of the frame 2, respectively, in the case where the frame 2 is divided into two equal parts. Furthermore, "e" and "f" denote a first half of a frame 3 and a second half of the frame 3, respectively, in the case where the frame 3 is divided into two equal parts.

Here, a first MDCT is performed on a concatenated signal (i.e., a, b, c, and d) of the frames 1 and 2. A second MDCT is performed on a concatenated signal (i.e., c, d, e, and f) of the frames 2 and 3. Note that c and d have the partial overlap (the overlap region).

Firstly, the MDCT applies a window expressed below to the concatenated signal.

[Math. 1]

$$[w_1, w_2, w_{2,R} w_{1,R}]$$

It should be noted that Expression 1 below corresponds to the first MDCT and that Expression 2 below corresponds to the second MDCT.

[Math. 2]

$$[aw_1, bw_2, cw_{2,R}, dw_{1,R}] \quad \text{Expression 1}$$

[Math. 3]

$$[cw_1, dw_2, ew_{2,R}, fw_{1,R}] \quad \text{Expression 2}$$

In order for the decoder to reliably perform complementary addition and aliasing cancellation, the window has the characteristics described by Expression 3 below.

[Math. 4]

$$w_1^2 + w_{2,R}^2 = 1 \quad \text{Expression 3}$$

Here, the subscript "R" represents time reversal/flip. To be more specific, such a relation can be seen in the first half cycle of a sine function, for example.

The decoder performs an inverse modified discrete cosine transform (IMDCT) on decoded MDCT coefficients. The signal obtained after the IMDCT for the first MDCT is described by Expression 4 below.

[Math. 5]

$$[aw_1 - b_R w_{2,R}, bw_2 - a_R w_{1,R}, cw_{2,R} + d_R w_1, dw_{1,R} + c_R w_2] \quad \text{Expression 4}$$

When the signal described by Expression 4 is compared with the original signal described by Expression 1, aliasing components described by Expression 5 below are caused.

[Math. 6]

$$[-b_R w_{2,R}, -a_R w_{1,R}, +d_R w_1, +c_R w_2] \quad \text{Expression 5}$$

Similarly, the signal obtained after the IMDCT for the second MDCT is described by Expression 6 below.

[Math. 7]

$$[cw_1 - d_R w_{2,R}, dw_2 - c_R w_{1,R}, ew_{2,R} + f_R w_1, fw_{1,R} + e_R w_2] \quad \text{Expression 6}$$

Here, Expression 4 and Expression 6 representing the IMDCT resulting signals are multiplied by a window described below.

[Math. 8]

$$[w_1, w_2, w_{2,R}, w_{1,R}]$$

As a result, Expression 7 and Expression 8 below are obtained.

[Math. 9]

$$[(aw_1 - b_R w_{2,R}) w_1, (bw_2 - a_R w_{1,R}) w_2, (cw_{2,R} + d_R w_1) w_{2,R}, (dw_{1,R} + c_R w_2) w_{1,R}] \quad \text{Expression 7}$$

[Math. 10]

$$[(cw_1 - d_R w_{2,R}) w_1, (dw_2 - c_R w_{1,R}) w_2, (ew_{2,R} + f_R w_1) w_{2,R}, (fw_{1,R} + e_R w_2) w_{1,R}] \quad \text{Expression 8}$$

Here, in consideration of the window characteristics described by Expression 3, the original signals c and d are obtained by adding the last two terms of Expression 7 to the first two terms of Expression 8. In other words, the aliasing components are cancelled.

From the viewpoint of algorithmic delay, when the number of samples is N as the frame size in the MDCT-based coding, a time period corresponding to the number of samples N is required to prepare a full frame for the MDCT. More specifically, a framing delay of N is caused. Moreover, aside from this delay, a MDCT delay (a filter delay) inherent in the number of samples N is caused. Therefore, the total delay results in 2N as the number of samples.

On the other hand, in the case of LP coding, the frames are coded one by one without any overlap. Therefore, as with the USAC, when LP coding is switched to transform coding (also referred to as LFD coding, such as the MDCT-based coding scheme or the TCX scheme) and vice versa, a solution is required to cancel aliasing caused by the switching at the boundaries.

According to the MPEG USAC, aliasing can be cancelled using a forward aliasing cancellation (FAC) tool.

Figure 2:
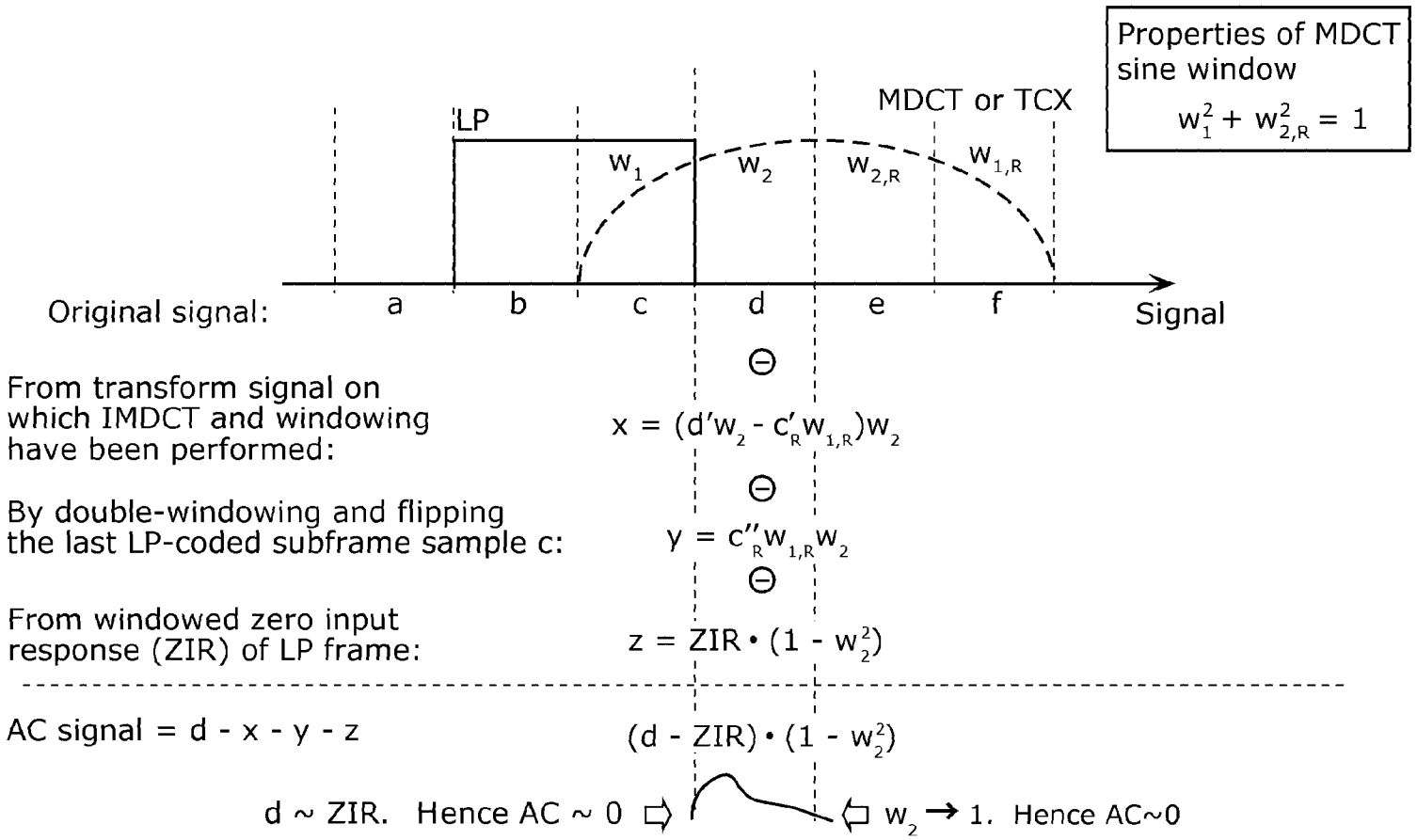
FIG. 2 is a diagram showing a method of generating an AC signal used when linear prediction (LP) coding is switched to transform coding.

FIG. 2 is a diagram showing the principle of the FAC tool.

In FIG. 2, "a" and "b" denote a first half of a frame 1and a second half of the frame 1, respectively, in the case where the frame 1 is divided into two equal parts. Moreover, "c" and "d" denote a first half of a frame 2 and a second half of the frame 2, respectively, in the case where the frame 2 is divided into two equal parts. Furthermore, "e" and "f" denote a first half of a frame 3 and a second half of the frame 3, respectively, in the case where the frame 3 is divided into two equal parts. LP coding is performed on the first half of the frame 1 and the second half of the frame 2 (i.e., b and c). The coding scheme is switched from LP coding to transform coding at the frame 2, and thus transform coding is performed on the frame 2 and the frame 3.

The subframe c is coded according to LP coding and, therefore, the decoder can fully decode the subframe c using only the coded subframe c. However, the subframe d is coded according to transform coding (MDCT or TCX). Thus, when the decoder decodes the subframe d as it is, the resulting decoded signal include an aliasing component. In order to cancel this aliasing component, the encoder generates first to third signals as follows.

As described by Expression 9, the encoder firstly performs the IMDCT using a local decoder, and generates a first windowed signal "x". Here, "d" and "c" represents the decoded counterparts of d and c, respectively.

[Math. 11]

$$x=(d'w_2-c'_R w_{1,R})w_2 \qquad \text{Expression 9}$$

Moreover, as described by Expression 10, the encoder generates a second signal "y" by double-windowing and flipping the signal c" that is obtained by decoding LP-coded subframe c using the local decoder.

[Math. 12]

$$y=(c''w_1w_{2,R})_R=c''_R w_{1,R}w_2 \qquad \text{Expression 10}$$

As described by Expression 11, a third signal is a zero input response (ZIR) obtained by performing windowing on the preceding LP frame. The zero input response (ZIR) refers to a process whereby, in finite impulse response (FIR) filtering, an output value is calculated when zero is inputted into an FIR filter while the state momentarily changes according to the previous inputs.

[Math. 13]

$$z=\mathrm{ZIR}(1-w_2^2) \qquad \text{Expression 11}$$

As described by Expression 12, an aliasing cancellation (AC) signal is calculated by subtracting the aforementioned three signals from the original signal d.

[Math. 14]

$$\mathrm{AC}=d-x-y-z=(d-d'w_2^2)+(c'_R-c_R'')w_{1,R}w_2-\mathrm{ZIR}(1-w_2^2) \qquad \text{Expression 12}$$

The AC signal has the characteristics as follows. When the coding performance is high enough and the decoded signal is thus similar in waveform to the original signal, this can be expressed as follows.

[Math. 15]

$$d\approx d'$$

[Math. 16]

$$c'\approx c''$$

Then, Expression 12 is approximated to Expression 13 below.

[Math. 17]

$$\mathrm{AC}\approx(d-\mathrm{ZIR})(1-w_2^2) \qquad \text{Expression 13}$$

Moreover, when the signal d is predicted at the start of the subframe d and the ZIR of the LP coding is reliable, the start of the subframe of the AC signal can be expressed as follows.

[Math. 18]

$$\mathrm{AC}\approx O$$

Furthermore, since w2−1 at the end of the subframe d, the end of the subframe of the AC signal can be expressed as follows.

[Math. 19]

$$\mathrm{AC}\approx O$$

To be more specific, the AC signal is shaped like a naturally windowed signal that converges to zero on both sides of the subframe d.

The AC signal is used when LP coding is switched to transform coding (MDCT/TCX). A similar AC signal is generated when transform coding (MDCT/TCX) is switched to LP coding.

The AC signal used when transform coding is switched to LP coding is different in that a ZIR component is not present. Moreover, the AC signal used when transform coding is switched to LP coding is also different in that the AC signal is not shaped like a windowed signal because the signal is not zero at the end of the subframe adjacent to the LP-coded frame.

Figure 3:
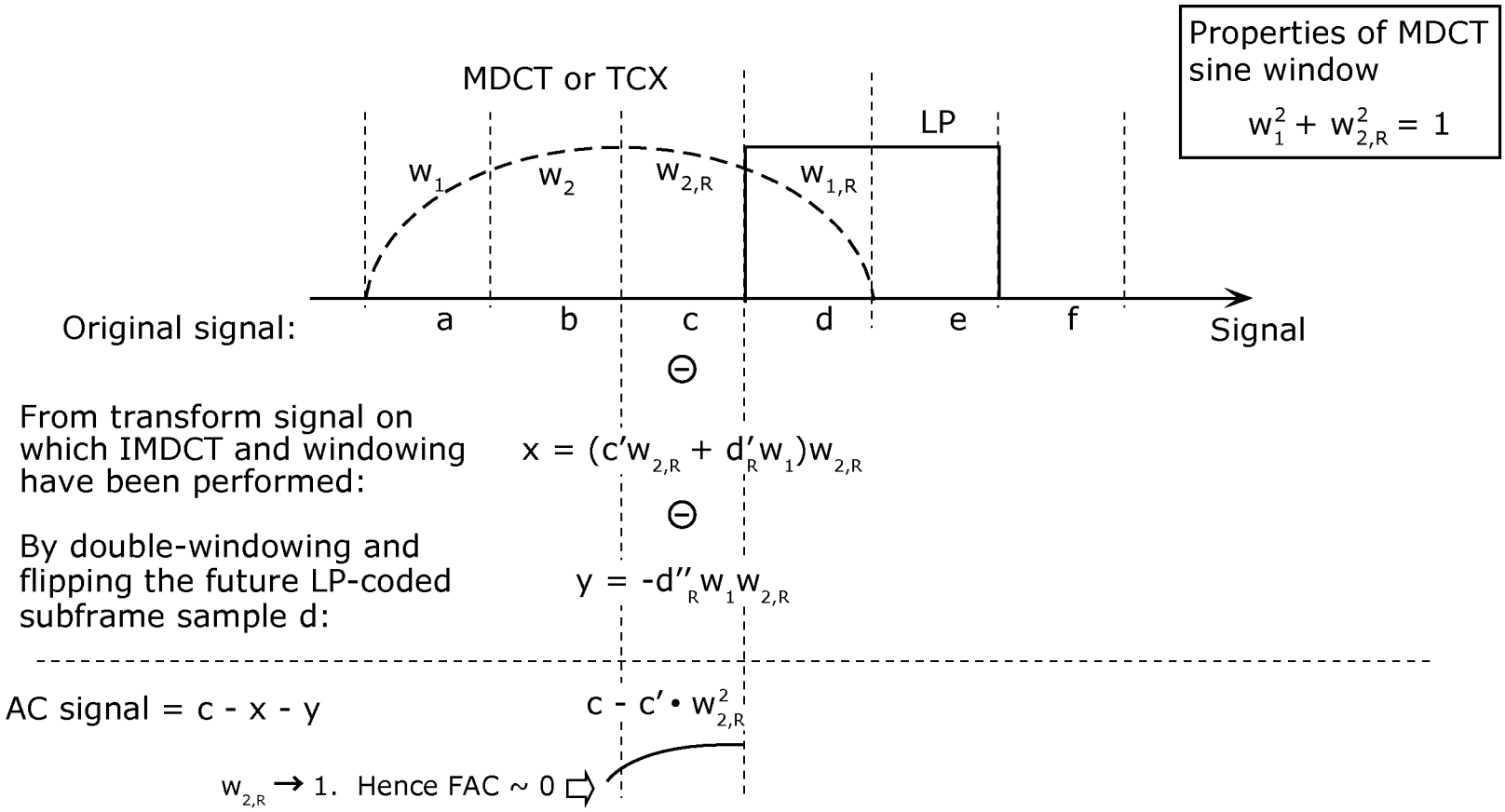
FIG. 3 is a diagram showing a method for generating an AC signal used when transform coding is switched to LP coding.

FIG. 3 is a diagram showing a method for generating the AC signal used when transform coding is switched to LP coding.

As shown in FIG. 3, the AC signal is generated to cancel the aliasing component included in the subframe c when transform coding is switched to LP coding. To be more specific, a first signal x described by Expression 14 and a second signal y described by Expression 15 are subtracted from an original signal c as described by Expression 16.

[Math. 20]

$$x=(c'w_{2,R}+d'_R w_1)w_{2,R} \quad \text{Expression 14}$$

[Math. 21]

$$y=-d''_R w_1 w_{2,R} \quad \text{Expression 15}$$

[Math. 22]

$$AC=c-x-y=c-c'w_{2,R}^2-(d'_R-d''_R)w_1 w_{2,R}\approx c-c'w_{2,R}^2 \quad \text{Expression 16}$$

Here, since w2,R−1 at the start (the left boundary), the AC signal is as follows.

[Math. 23]

$$\approx O$$

The example of generating the AC signal at the encoder has been thus described. It should be noted that an operation performed at the decoder is the reverse of the operation performed at the encoder and, therefore, the description is omitted here.

In recent times, with the rise of social networking culture, a growing number of Internet-savvy people are participating in social activities such as video conferences and entertainment through audio and video. With this being the situation, as one of the activities that is expected to become popular, users from different locations gather via the Internet to play musical instruments for each other or to sing in chorus or a cappella in real time (hereafter, such an activity is referred to as the "networked music performance").

When the networked music performance is carried out, it is important to perform low-delay coding and low-delay decoding on a sound signal in order for the user not to have a feeling of strangeness.

To be more specific, in order to prevent the "out of sync" perceived by the human ear, a total delay time that is the sum of the signal processing time and the time taken for the signal to be transmitted via the network (the network delay) needs to be less than 30 milliseconds (ms) (see Non Patent Literature 1, for example). When echo cancellation and network delay account for 20 ms of the total delay time, an algorithmic delay tolerated in coding and decoding is about 10 ms.

Here, the aforementioned MPEG USAC has a long algorithmic delay. For this reason, the MPEG USAC is not suitable for an application, such as networked music performance, that requires low delay. Main delays in the MPEG USAC are caused for the following reasons 1 to 3.

1. The main delay is caused in both the encoder and the decoder because of the large frame size. Currently, the frame sizes of 768 samples and 1024 samples are permitted in the MPEG USAC standard. Here, in the MPEG USAC, when the number of samples is N, a delay of 2N is caused in transform coding. More specifically, a delay of 1536 or 2048 samples is caused. When the sampling frequency is 48 kHz, a delay of 32 ms or 43 ms is caused from a core MDCT+framing delay.

2. A second main delay is caused in both the encoder and the decoder because of the QMF analysis and synthesis filter bank for the SBR and MPS. A conventional filter bank having a symmetrical typical window causes a delay of additional 577 samples or 12 ms at a sampling frequency of 48 kHz.

3. A main delay of the encoder is a look-ahead delay caused by the signal classification unit of the encoder. The signal classification unit analyzes the transition, tone quality, and spectral tilt of the signal (the characteristics of the signal), and then determines whether the signal should be coded by the scheme according to MDCT, LP, or TCX. In general, this causes another one frame delay which is 16 ms or 21 ms at a sampling frequency of 48 kHz.

In view of 1 to 3 described above, the frame size firstly needs to be significantly reduced to implement very low delay. However, a reduction in the frame size reduces the coding efficiency in transform coding and, on this account, it is more important to efficiently use bits for quantization than ever before.

As described above, particularly when switching between LP coding and transform coding (MDCT/TCX) takes place, the aliasing component of the transform-coded frame is synthesized with the decoded LP signal (Expression 10, for example). To cancel the aliasing component, the encoder generates and codes an additional aliasing residual signal called the AC signal as described above. Ideally, the amount of data for coding the AC signal should be as small as possible to minimize the load of coding.

However, in spite of using the AC signal, the aliasing component cannot always be fully cancelled. For example, as shown in FIG. 2, when the coding scheme is switched from LP coding to transform coding (MDCT/TCX), the AC signal is calculated to be zero at the beginning based on the ZIR of the preceding LP-coded subframe c.

This allows the AC signal to be a seemingly windowed signal that facilitates the efficient coding by using a specific quantization method. However, by the method of generating the AC signal shown in FIG. 2, the start of the subframe d is predicted based on the ZIR of the subframe c. On account of this, when the signal characteristics suddenly change for example, the aliasing component cannot be fully cancelled.

Moreover, as shown in FIG. 3, when the coding scheme is switched from transform coding (MDCT/TCX) to LP coding, the AC signal is not zero at the end of the subframe c. This results in inefficient coding for a specific quantization method, as explained in the previous paragraph.

As a third reason, the AC signal does not become smaller in waveform than the coded original signal, and the aliasing-cancelled MDCT signal and LP signal become similar to the original signal. At high bit rates, the original signal is similar in waveform to the decoded signal in some cases and, therefore, the AC signal is unnecessary burden in coding.

In view of the above, in order to achieve low delay, a codec according to the present invention is based on the overall configuration in the MPEG USAC and has the basic configuration described in the following 1 to 3.

1. In the basic configuration, the frame size is small. To be more specific, the size of 256 samples is recommended as the frame size. However, this recommended size is not intended to be limiting. With this, a delay to be caused is, as the number of samples, 512=2*256. At the sampling frequency of 48 kHz, a delay of 11 ms is caused from a MDCT+framing delay.

2. Moreover, in the basic configuration, an overlap between the consecutive MDCT frames is reduced to further reduce the delay (see Non Patent Literature 4, for example). Here, a recommended overlap size is 128 samples. With this, the MDCT+framing delay results in, as the number of samples, 384=256+128. At the sampling frequency of 48 kHz, a delay of 8 ms is caused. In other words, the caused delay is reduced from 11 ms mentioned above to 8 ms.

3. Furthermore, in the basic configuration, a complex low-delay filter bank having an asymmetrical typical window is used. The structure of a low-delay QMF filter bank is well known and described in Non Patent Literature 2. Moreover, the structure has already been employed in MPEG AAC-ELD (see Non Patent Literature 3). By the complex low-delay filter bank, the length of the asymmetrical typical window is reduced to half, and a subband count (M) parameter and a past extension (E) parameter are adjusted. As a result, a delay of less than 2 ms can be implemented. For example, when M=64, E=8, and the typical window length is 640, the complex low-delay QMF filter bank of MPEG ACC-ELD implements a delay of 64 samples or 1.3 ms at the sampling frequency of 48 kHz.

With the basic configuration described above, the codec according to the present invention can implement an algorithmic delay of 10 ms.

Here, this basic configuration causes coding overhead because the frame size is reduced. Thus, bit overhead caused by the AC signal is more pronounced. The aforementioned bit overhead is particularly pronounced in the case where codec switching is carried out rapidly. On this account, the challenge here is how to efficiently generate the AC signal.

In order to solve this challenge, the inventors of the present application has found a method of generating the AC signal more efficiently.

A sound signal hybrid encoder in an aspect according to the present invention is a sound signal hybrid encoder including: a signal analysis unit which analyzes characteristics of a sound signal to determine a scheme for encoding a frame included in the sound signal; a lapped frequency domain (LFD) encoder which encodes a frame included in the sound signal by performing an LFD transform on the frame, to generate an LFD frame; a linear prediction (LP) encoder which encodes a frame included in the sound signal by calculating and using linear prediction coefficients of the frame, to generate an LP frame; a switching unit which switches, for frame encoding, between the LFD encoder and the LP encoder, according to a result of the determination by the signal analysis unit; a local decoder which generates a locally-decoded signal including (1) a signal obtained by decoding at least a part of an aliasing cancellation (AC) target frame that is the LFD frame adjacent to the LP frame according to switching control by the switching unit and (2) a signal obtained by decoding at least a part of the LP frame adjacent to the AC target frame; and an AC signal generation unit which generates, using the sound signal and the locally-decoded signal, an AC signal used for cancelling aliasing caused when the AC target frame is decoded, and outputs the generated AC signal, wherein, when the AC target frame is immediately after the LP frame or when the AC target frame is immediately before the LP frame, the AC signal generation unit (1) generates the AC signal according to a scheme selected from among a plurality of schemes and outputs the generated AC signal and (2) outputs an AC flag indicating the selected scheme.

With this, the sound signal hybrid encoder can efficiently generate the AC signal by selecting one of the schemes to generate and output the AC signal.

Moreover, for example, the AC signal generation unit may generate the AC signal according to the scheme selected from a first scheme and a second scheme that is different from the first scheme, and output the generated AC signal.

Furthermore, for example, the sound signal hybrid encoder may further include a quantizer which quantizes the AC signal, wherein the AC signal generation unit may generate the AC signal according to each of the first scheme and the second scheme and output the AC signal, out of the two generated AC signals, that is smaller in an amount of coded data obtained by the quantization by the quantizer.

With this, the sound signal hybrid encoder can select and output the AC signal having the less amount of coded data.

Moreover, for example, when the AC target frame is immediately after the LP frame, the first scheme may generate the AC signal using a zero input response obtained by performing windowing on the LP frame immediately preceding the AC target frame, and the second scheme may generate the AC signal without using the zero input response.

Furthermore, for example, the first scheme may be standardized by unified speech and audio coding (USAC), and the amount of coded data obtained by the quantization performed on the generated AC signal may be assumed to be smaller by the second scheme than by the first scheme.

Moreover, for example, the AC signal generation unit may select the first scheme when a frame size of the sound signal is larger than a predetermined size, and select the second scheme when the frame size of the sound signal is smaller than or equal to the predetermined size.

In the case where the second scheme is effective when the frame size is small, this configuration also allows the low-bit-rate efficient coding to be implemented.

Furthermore, for example, the sound signal hybrid encoder may further include a quantizer which quantizes the AC signal, wherein the AC signal generation unit may generate the AC signal according to the first scheme, and select the first scheme when the amount of coded data obtained by the quantization performed by the quantizer on the AC signal generated according to the first scheme is smaller than a predetermined threshold, and when the amount of coded data obtained by the quantization performed by the quantizer on the AC signal generated according to the first scheme is larger than or equal to the predetermined threshold, the AC signal generation unit may further generate the AC signal according to the second scheme and output the AC signal, out of the AC signals generated according to the first and second schemes, that is smaller in the amount of coded data obtained by the quantization performed by the quantizer.

With this, when the amount of coded data of the AC signal generated by the first scheme is small enough, the AC signal does not need to be generated by the second scheme. Thus, the throughput for the AC signal generation can be reduced.

Moreover, for example, the AC signal generation unit may further include: a first AC candidate generator which generates the AC signal according to the first scheme; a second AC candidate generator which generates the AC signal according to the second scheme; and an AC candidate selector which (1) outputs the AC signal generated by the first AC candidate generator or the second AC candidate generator that is selected and (2) outputs the AC flag indicating whether the outputted AC signal is generated according to the first scheme or the second scheme.

Furthermore, for example, the sound signal hybrid encoder further include: a low-delay (LD) analysis filter bank which generates an input subband signal by converting an input signal into a time-frequency domain representation; a multichannel extension unit which generates a multichannel extension parameter and a downmix subband signal, from the input subband signal; a bandwidth extension unit which generates a bandwidth extension parameter and a narrowband subband signal, from the downmix subband signal; an LD synthesis filter bank which generates the sound signal by converting the narrowband subband signal from the time-frequency domain representation to a time domain representation; a quantizer which quantizes the multichannel extension parameter, the bandwidth extension parameter, the outputted AC signal, the LFD frame, and the LP frame; and a bitstream multiplexer which multiplexes the signal quantized by the quantizer and the AC flag and transmits a result of the multiplexing.

Moreover, for example, the LFD encoder may encode the frame according to a transform coded excitation (TCX) scheme.

Furthermore, for example, the LFD encoder may encode the frame according to a modified discrete cosine transform (MDT), the switching unit may perform windowing on the frame to be encoded by the LFD encoder, and a window used in the windowing may monotonically increase or monotonically decrease in a period that is shorter than half of a length of the frame.

Moreover, a sound signal hybrid decoder in aspect according to the present invention is a sound signal hybrid decoder which decodes a coded signal including an LFD frame coded by an LFD transform, an LP frame coded using linear prediction coefficients, and an AC signal used for cancelling aliasing of an AC target frame that is the LFD frame adjacent to the LP frame, the sound signal hybrid decoder including: an inverse lapped frequency domain (ILFD) decoder which decodes the LFD frame; an LP decoder which decodes the LP frame; a switching unit which outputs a second narrowband signal in which the LFD frame that is decoded by the ILFD decoder and windowed and the LP frame decoded by the LP decoder are aligned in order; an AC output signal generation unit which obtains an AC flag indicating a scheme used for generating the AC signal and generates, according to the scheme indicated by the AC flag, an AC output signal in which a signal outputted from the switching unit, the RFD decoder, or the LP decoder is added to the AC signal; and an addition unit which outputs a third narrowband signal in which the AC output signal is added to a part corresponding to the AC target frame included in the second narrowband signal.

Furthermore, for example, the sound signal hybrid decoder may further include: a bitstream demultiplexer which obtains the coded signal that is quantized and a bitstream including the AC flag; an inverse quantizer which generates the coded signal by performing inverse quantization on the quantized coded signal; an LD analysis filter bank which generates a narrowband subband signal by converting the third narrowband signal outputted from the addition unit into a time-frequency domain representation; a bandwidth extension decoding unit which synthesizes a high frequency signal to generate a bandwidth-extended subband signal, by applying a bandwidth extension parameter included in the coded signal generated by the inverse quantizer to the narrowband subband signal; a multichannel extension decoding unit which generates a multichannel subband signal by applying a multichannel extension parameter included in the coded signal generated by the inverse quantizer to the bandwidth-extended subband signal, and an LD synthesis filter bank which generates a multichannel signal by converting the multichannel subband signal from the time-frequency domain representation to a time domain representation.

Moreover, for example, the AC signal may be generated according to a first scheme or a second scheme that is different from the first scheme, and the AC output signal generation unit may further include: a first AC candidate generator which generates the AC output signal corresponding to the AC signal generated according to the first scheme; a second AC candidate generator which generates the AC output signal corresponding to the AC signal generated according to the second scheme; and an AC candidate selector which selects either one of the first AC candidate generator and the second AC candidate generator according to the AC flag, and causes the selected first or second AC candidate generator to generate the AC output signal.

These general and specific aspects may be implemented using a system, a method, an integrated circuit, a computer program, or a computer-readable recording medium such as a CD-ROM, or any combination of systems, methods, integrated circuits, computer programs, or computer-readable recording media.

Hereinafter, certain exemplary embodiments are described in greater detail with reference to the accompanying Drawings. Each of the exemplary embodiments described below shows a general or specific example. The numerical values, shapes, materials, structural elements, the arrangement and connection of the structural elements, steps, the processing order of the steps etc. shown in the following exemplary embodiments are mere examples, and therefore do not limit the scope of the appended Claims and their equivalents. Therefore, among the structural elements in the following exemplary embodiments, structural elements not cited in any one of the independent claims are described as arbitrary structural elements.

[Embodiment 1]

Embodiment 1 describes a sound signal hybrid encoder.

Figure 4:
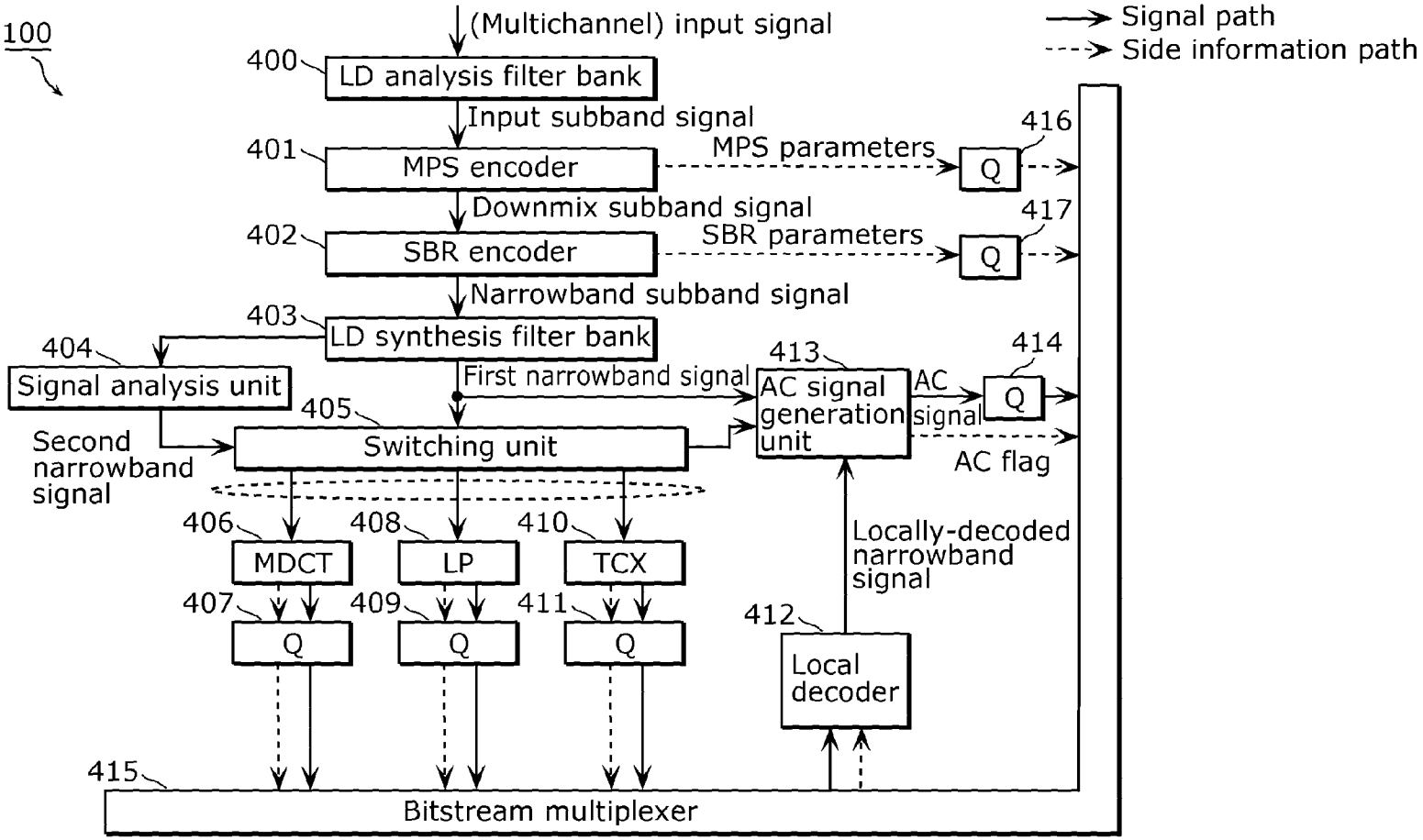
FIG. 4 is a block diagram showing a configuration of a sound signal hybrid encoder in Embodiment 1.

FIG. 4 is a block diagram showing a configuration of the sound signal hybrid encoder in Embodiment 1.

A sound signal hybrid encoder 100 includes a low-delay (LD) analysis filter bank 400, an MPS encoder 401, an SBR encoder 402, an LD synthesis filter bank 403, a signal analysis unit 404, and a switching unit 405. Moreover, the sound signal hybrid encoder 100 includes an audio encoder 406 including an MDCT filter bank (simply referred to as the "MDCT encoder 406" hereafter), an LP encoder 408, and a TCX encoder 410. Furthermore, the sound signal hybrid encoder 100 includes a plurality of quantizers 407, 409, 411, 414, 416, and 417, a bitstream multiplexer 415, a local decoder 412, and an AC signal generation unit 413.

The LD analysis filter bank 400 generates an input subband signal expressed by a hybrid time-frequency representation, by performing an LD analysis filter bank process on an input signal (multichannel input signal). As a specific choice for the low-delay filter bank, the low-delay QMF filter bank disclosed in Non Patent Literature 2 can be used for instance. However, the choice is not intended to be limiting.

The MPS encoder 401 (multichannel extension unit) converts the input subband signal generated by the LD analysis filter bank 400 into a set of smaller signals which are downmix subband signals, and generates MPS parameters. Here, the downmix subband signal refers to a full-band downmix subband signal.

For example, when the input signal is a stereo signal, only one downmix subband signal is generated. It should be noted that the MPS parameters are quantized by the quantizer 416.

The SBR encoder 402 (bandwidth extension unit) downsamples the downmix subband signals to a set of narrowband subband signals. In this process, the SBR parameters are generated. It should be noted that the SBR parameters are quantized by the quantizer 417.

The LD synthesis filter bank 403 transforms the narrowband subband signal back to the time domain and generates a first narrowband signal (sound signal). Again, the low-delay QMF filter bank disclosed in Non Patent Literature 2 can also be used here.

The signal analysis unit 404 analyzes the characteristics of the first narrowband signal, and selects the most suitable encoder from among the MDCT encoder 406, the LP encoder 408, and the TCX encoder 410 for coding the first narrowband signal. It should be noted that, in the following description, each of the MDCT encoder 406 and the TCX encoder 410 may also be referred to as the lapped frequency domain (LFD) encoder.

For example, the signal analysis unit 404 can select the MDCT encoder 406 for the first narrowband signal that is remarkably tonal overall and exhibits small fluctuations in the spectral tilt. When the MDCT criterion cannot be applied, the signal analysis unit 404 selects the LP encoder 408 for the first narrowband signal that has great tone quality in a low frequency region and exhibits large fluctuations in the spectral tilt. For the first narrowband signal to which neither of the above criteria cannot be applied, the TCX encoder 410 is selected.

It should be noted that the above criteria used by the signal analysis unit 404 for determining the encoder are merely examples and are not intended to be limiting. Any criterion may be used as long as the signal analysis unit 404 analyzes the first narrowband signal (the sound signal) and determines the method for coding a frame included in the first narrowband signal.

The switching unit 405 performs switching control to determine, based on the result of the determination by the signal analysis u nit 404, whether the frame should be coded by the LFD encoder (the MDCT encoder 406 or the TCX encoder 410) or by the LP encoder 408. To be more specific, the switching unit 405 selects a subset of samples for the frames to be coded (the past and current frames) included in the first narrowband signal, on the basis of the encoder selected according to the result of the determination by the signal analysis unit 404. Then, from the set of subsamples, the switching unit 405 generates a second narrowband signal for subsequent coding.

Here, when the MDCT is selected, the switching unit 405 performs windowing on the selected sample subset.

Figure 5:
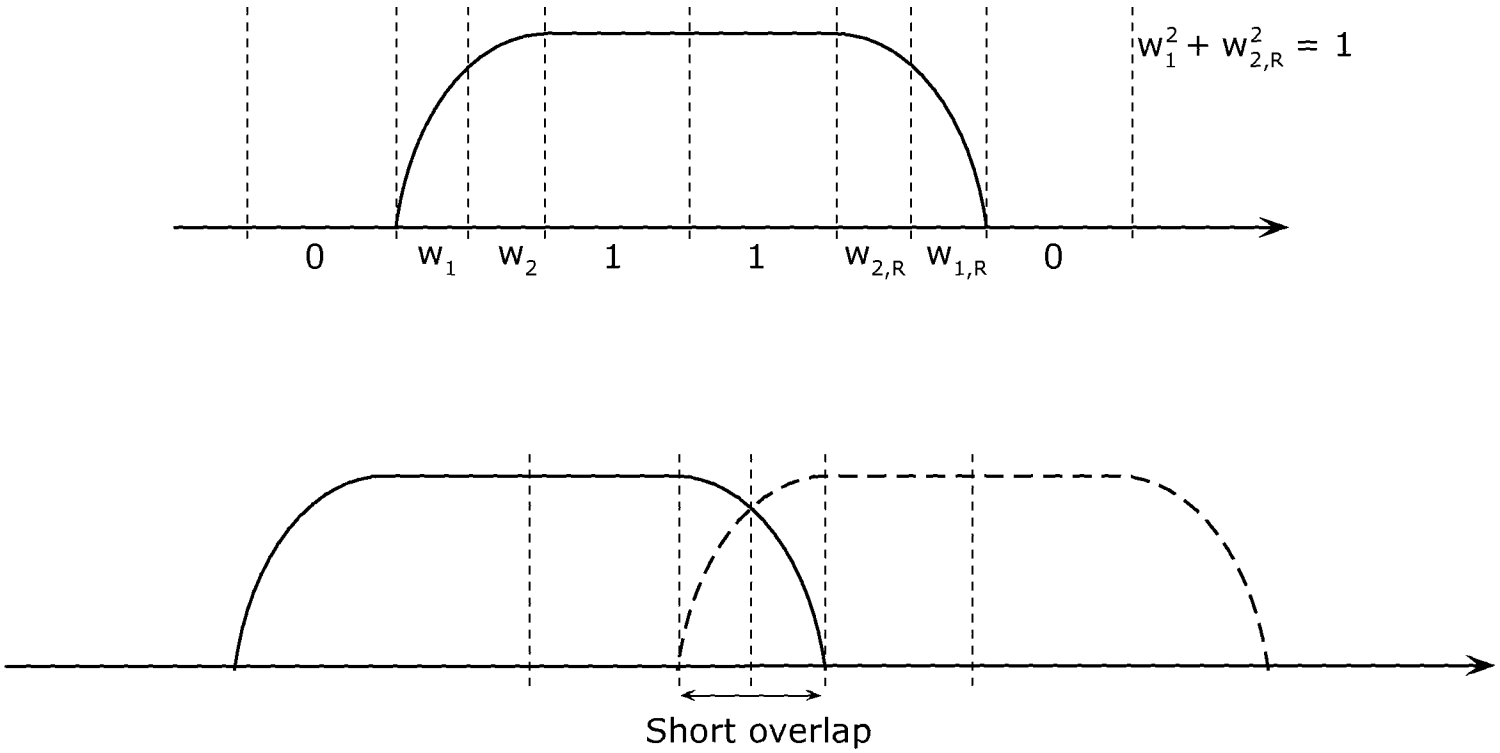
FIG. 5 is a diagram showing the shape of a window having a short overlap.

FIG. 5 is a diagram showing the shape of a window having a short overlap. It is preferable that the window for the sound signal hybrid encoder 100 have a short overlap as shown in FIG. 5. In Embodiment 1, when the MDCT is selected, the switching unit 405 performs such windowing.

It should be noted that the window shown in, for example, FIG. 1, monotonically increases in a period that is half of the frame length and monotonically decreases in the period that is half of the frame length. On the other hand, the window shown in FIG. 5 monotonically increases in a period shorter than half of the frame length and monotonically decreases in the period shorter than half of the frame length. This means that the overlap is short.

The MDCT encoder 406 codes a current frame to be coded, according to the MDCT.

The LP encoder 408 codes the current frame by calculating linear prediction coefficients of the current frame. The LP encoder 408 is based on a code excited linear prediction (CELP) scheme such as algebraic code excited linear prediction (ACELP) or vector sum excited linear prediction (VSELP).

The TCX encoder 410 coded the current frame according to the TCX scheme. To be more specific, the TCX encoder 410 codes the current frame by calculating linear prediction coefficients of the current frame and performing the MDCT on residues of the linear prediction coefficients.

It should be noted, in the following description, that a frame coded by the MDCT encoder 406 or the TCX encoder 410 is referred to as an "LFD frame", and that a frame coded by the LP encoder 408 is referred to as an "LP frame". Note also that the LFD frame to which aliasing is to be caused by the switching controlled by the switching unit 405 is referred to as an "AC target frame".

To be more specific, the AC target frame is the LFD frame that is adjacent to the LP frame and coded according to the switching control performed by the switching unit 405. As the AC target frame, two types are present as follows. One is the frame coded immediately after the LP frame (i.e., the AC target frame is immediately subsequent to the LP frame). The other is the frame coded immediately before the LP frame (i.e., the AC target frame is immediately prior to the LP frame).

The quantizers 407, 409, and 411 quantize outputs of the encoders. To be more specific, the quantizer 407 quantizes the output of the MDCT encoder 406. The quantizer 409 quantizes the output of the LP encoder 408. The quantizer 411 quantizes the output of the TCX encoder 410.

In general, the quantizer 407 is a combination of a dB-step quantizer and Huffman coding. The quantizer 409 and the quantizer 411 are vector quantizers.

The local decoder 412 obtains the AC target frame and the LP frame adjacent to this AC target frame, from the bitstream multiplexer 415. Then, the local decoder 412 decodes at least part of the obtained frames to generate locally-decoded signals. The locally-decoded signals are narrowband signals decoded by the local decoder 412, or more specifically, d' and c' in Expression 10, c" in Expression 11, and d" in Expression 15.

The AC signal generation unit 413 generates the AC signal used for cancelling aliasing caused when the AC target frame is decoded, using the aforementioned first signal and the first narrowband signal. Then, the AC signal generation unit 413 outputs the generated AC signal. More specifically, the AC signal generation unit 413 generates the AC signal by utilizing the past decoded data (past frame) provided by the local decoder 412.

In Embodiment 1, the AC signal generation unit 413 generates a plurality of AC signals according to a plurality of AC processes (schemes), and determines which one of the generated AC signals is more bit-efficient to code. Moreover, the AC signal generation unit 413 selects the AC signal that is more bit-efficient to code, and outputs the selected AC signal and an AC flag indicating the AC process used for generating this AC signal. Note that the selected AC signal is quantized by the quantizer 414.

The bitstream multiplexer 415 writes all the coded frames and side information into a bitstream. To be more specific, the bitstream multiplexer 415 multiplexes and transmits the signals quantized by the quantizers 407, 409, 411, 414, 416, and 417 and the AC flags.

The following is a detailed description on a configuration and an operation of the AC signal generation unit 413. Here, this operation is a characteristic operation of the sound signal hybrid encoder 100 in Embodiment 1.

Figure 6:
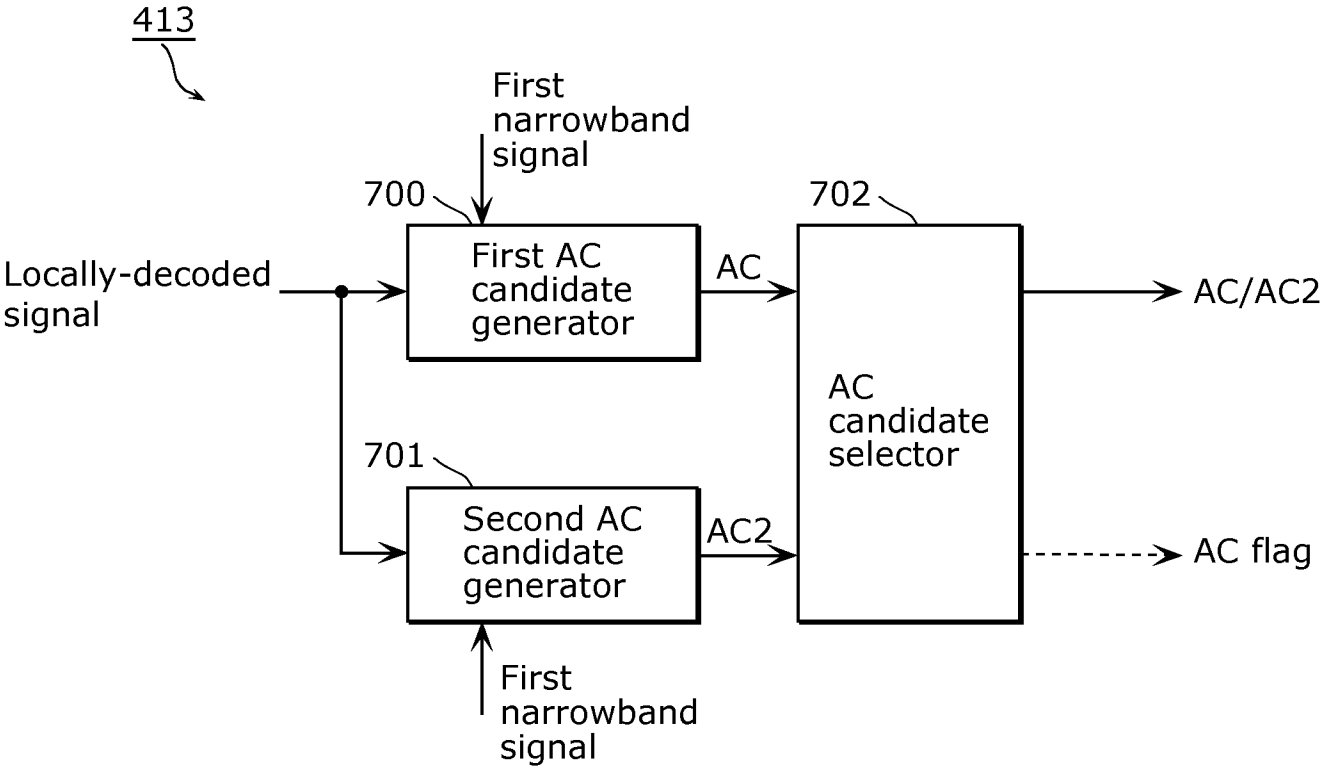
FIG. 6 is a block diagram showing an example of a configuration of an AC signal generation unit.

FIG. 6 is a block diagram showing an example of the configuration of the AC signal generation unit 413.

As shown in FIG. 6, the AC signal generation unit 413 includes a first AC candidate generator 700, a second AC candidate generator 701, and an AC candidate selector 702.

Each of the first AC candidate generator 700 and the second AC candidate generator 701 calculates the AC candidate which is the candidate for the AC signal eventually outputted from the AC signal generation unit 413, by using the first narrowband signal and the locally-decoded signal. It should be noted, in the following description, that the AC candidate generated by the first AC candidate generator 700 may also be simply referred to as "AC" and that the AC candidate generated by the second AC candidate generator 701 may also be simply referred to as "AC2".

Moreover, note that the first AC candidate generator 700 generates the AC candidate (the AC signal) according to a first scheme and that the second AC candidate generator 701 generates the AC candidate (the AC signal) according to a second scheme. The details on the first scheme and the second scheme are described later.

The AC candidate selector 702 selects either AC or AC2 as the AC candidate, based on a predetermined condition. Here, in Embodiment 1, the predetermined condition is the amount of coded data obtained when the AC candidate is quantized. The AC candidate selector 702 outputs the selected AC candidate and the AC flag indicating the first scheme or the second scheme that is used for generating the selected AC candidate.

Figure 7:
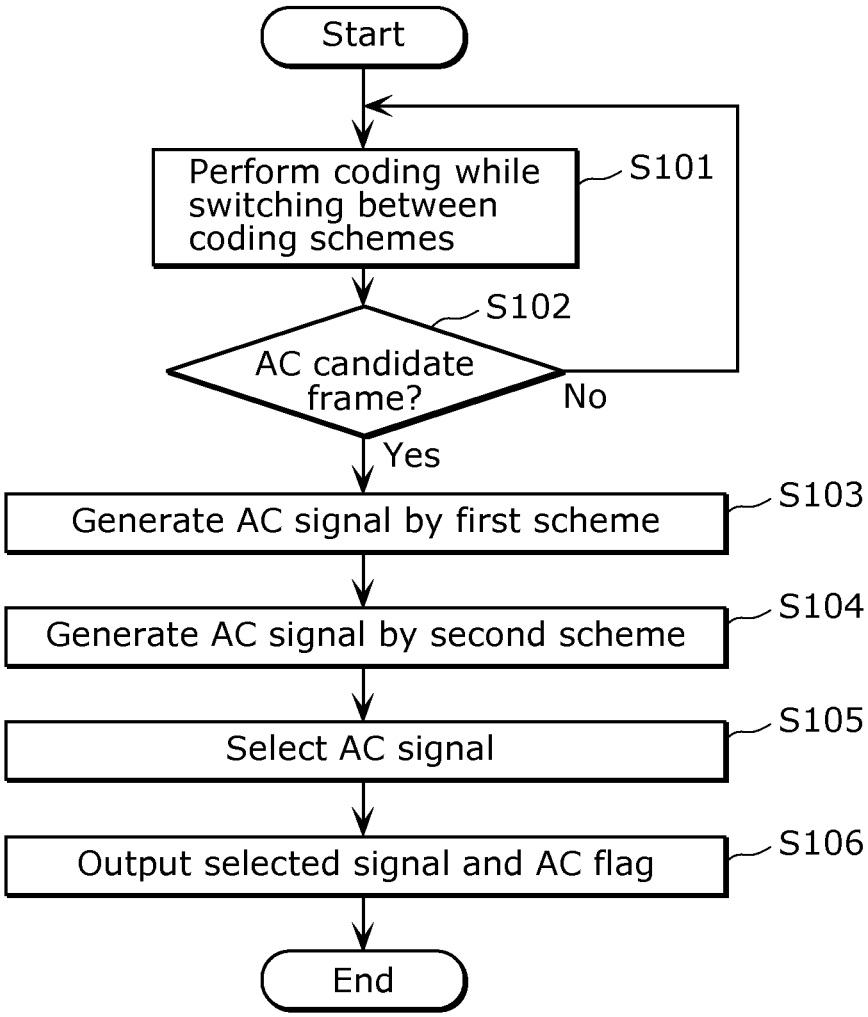
FIG. 7 is a flowchart showing an example of an operation performed by the AC signal generation unit.

FIG. 7 is a flowchart showing an example of the operation performed by the AC signal generation unit 413

As described above, in the sound signal hybrid encoder 100, the first narrowband signal is coded while the switching unit 405 switches between the coding schemes according to the result of the determination by the signal analysis unit 404 (S101 and No in S102).

When the current frame to be coded is the AC target frame (Yes in S102), the AC signal generation unit 413 first generates the AC signal according to the first scheme (S103). To be more specific, the first AC candidate generator 700 generates AC using the first narrowband signal and the locally-decoded signal.

Next, the AC signal generation unit 413 generates the AC signal according to the second scheme (S104). To be more specific, the second AC candidate generator 701 generates AC2 using the first narrowband signal and the locally-decoded signal.

After this, the AC signal generation unit 413 selects either AC or AC2 as the AC candidate (the AC signal) (S105). To be more specific, the AC candidate selector 702 selects AC or AC2 that is smaller in the amount of coded data obtained as a result of the quantization performed by the quantizer 414.

Finally, the AC signal generation unit 413 outputs the AC candidate (the AC signal) selected in step S105 and the AC flag indicating the scheme used for generating this selected AC candidate (S106).

As described thus far, the AC signal generation unit 413 selects and outputs the AC signal generated by the first scheme or the AC signal generated by the second scheme, based on the predetermined condition. Moreover, the AC signal generation unit 413 outputs the AC signal indicating whether the outputted AC signal its generated according to the first scheme or the second scheme.

Note that the AC signal generation unit 413 generates the AC signals according to the respective two schemes, for the cases where the AC target frame is coded immediately after the LP frame and where the AC target frame is coded immediately before the LP frame.

Next, the first scheme and the second scheme are described in detail. In the following description, one specific example is provided for each of the first scheme and the second scheme. However, note that these specific examples are not intended to be limiting and that any scheme may be employed.

Firstly, the first scheme and the second scheme in the case where LP coding is switched to transform coding (MDCT/TCX) are described.

As described above with reference to FIG. 2, the first scheme is the AC process that is usually employed in the MPEG USAC, and is used for generating the AC candidate (AC) according to Expression 12. More specifically, the first AC candidate generator 700 generates the AC candidate (AC) according to Expression 12.

However, as mentioned above, whether the AC signal generated by the first scheme can fully cancel aliasing depends largely on the reliability of the ZIR. When the ZIR component is larger, it is more difficult to cancel aliasing. On the other hand, when the ZIR component is smaller, it is easier to cancel aliasing. Moreover, even when the decoded signal is extremely similar in waveform to the original signal, aliasing cannot be accordingly reduced. This is because the ZIR is likely to be increasingly different from the original signal as time passes.

With this being the situation, the AC signal generation unit 413 further generates the AC signal according to the second scheme without using the ZIR. Preferably, in the case of the second scheme, the amount of coded data obtained as a result of the quantization performed on the generated AC signal is assumed to be smaller than in the case of the first scheme (that is, the second scheme is assumed to prioritize the amount of coded data over aliasing cancellation). Various methods can be employed as the second scheme. Examples of the second scheme include: a method of reducing the number of quantized bits obtained by quantizing the AC signal to be less than a normal number of quantized bits, when the amplitude of the AC signal is small; and a method of reducing the degree of filter coefficients when the AC signal is expressed by an LPC filter.

Figure 8:
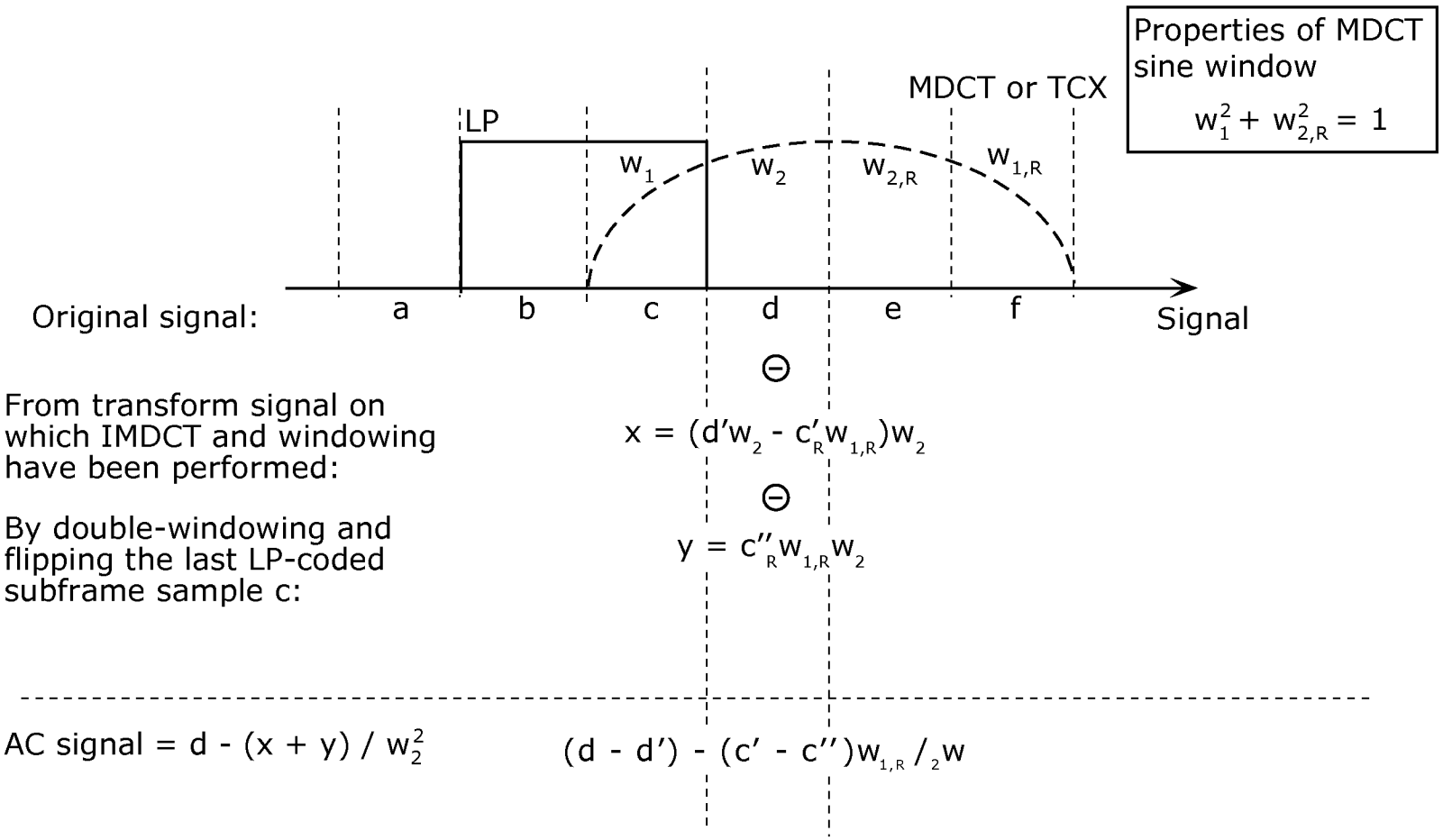
FIG. 8 is a diagram showing a second scheme for generating an AC signal used when LP coding is switched to transform coding.

FIG. 8 is a diagram showing the second scheme for generating the AC signal used when LP coding is switched to transform coding. To be more specific, the second AC candidate generator 701 generates the AC candidate (AC2) according to Expression 17 below.

[Math. 24]

$$AC2=d-(x+y)/w_2^2 \qquad \text{Expression 17}$$

Here, by substituting "x" in Expression 9 and "y" in Expression 10 into Expression 17 for expansion, the rationale of Expression 17 can be understood as described by Expressions 18 and 19 below.

[Math. 25]

$$AC2=(d-d')-(c'_R-c''_R)w_{1,R}/w_2 \qquad \text{Expression 18}$$

[Math. 26]

$$c'\approx c''$$

When the above expression is the same as described earlier, AC2 is approximated as shown by Expression 19 below.

[Math. 27]

$$AC2\approx(d-d') \qquad \text{Expression 19}$$

As shown by Expression 19, it is highly possible that AC2 is a signal that is more bit-efficient than AC. As compared with AC, the AC2 signal is highly likely to have less signal level fluctuations. When such a signal like AC2 is quantized, the quantization accuracy is hard to deteriorate even when the number of bits to be assigned to quantization is reduced to a certain extent. On this account, it is highly possible that AC2 is more bit-efficient than AC particularly when the decoded signal d' is likely to be similar in waveform to the original signal d or particularly in the case of a coding condition whereby the bit rate is likely to be higher and a difference between d and d' is likely to be small.

Next, the first scheme and the second scheme in the case where transform coding (MDCT/TCX) is switched to LP coding are described.

As described above with reference to FIG. 3, the first scheme is the AC process that is usually employed in the MPEG USAC, and is used for generating the AC candidate (AC) according to Expression 16. More specifically, the first AC candidate generator 700 generates the AC candidate (AC) according to Expression 16.

Moreover, the AC signal generation unit 413 further generates the AC signal according to the second scheme for the same reason as described above.

Figure 9:
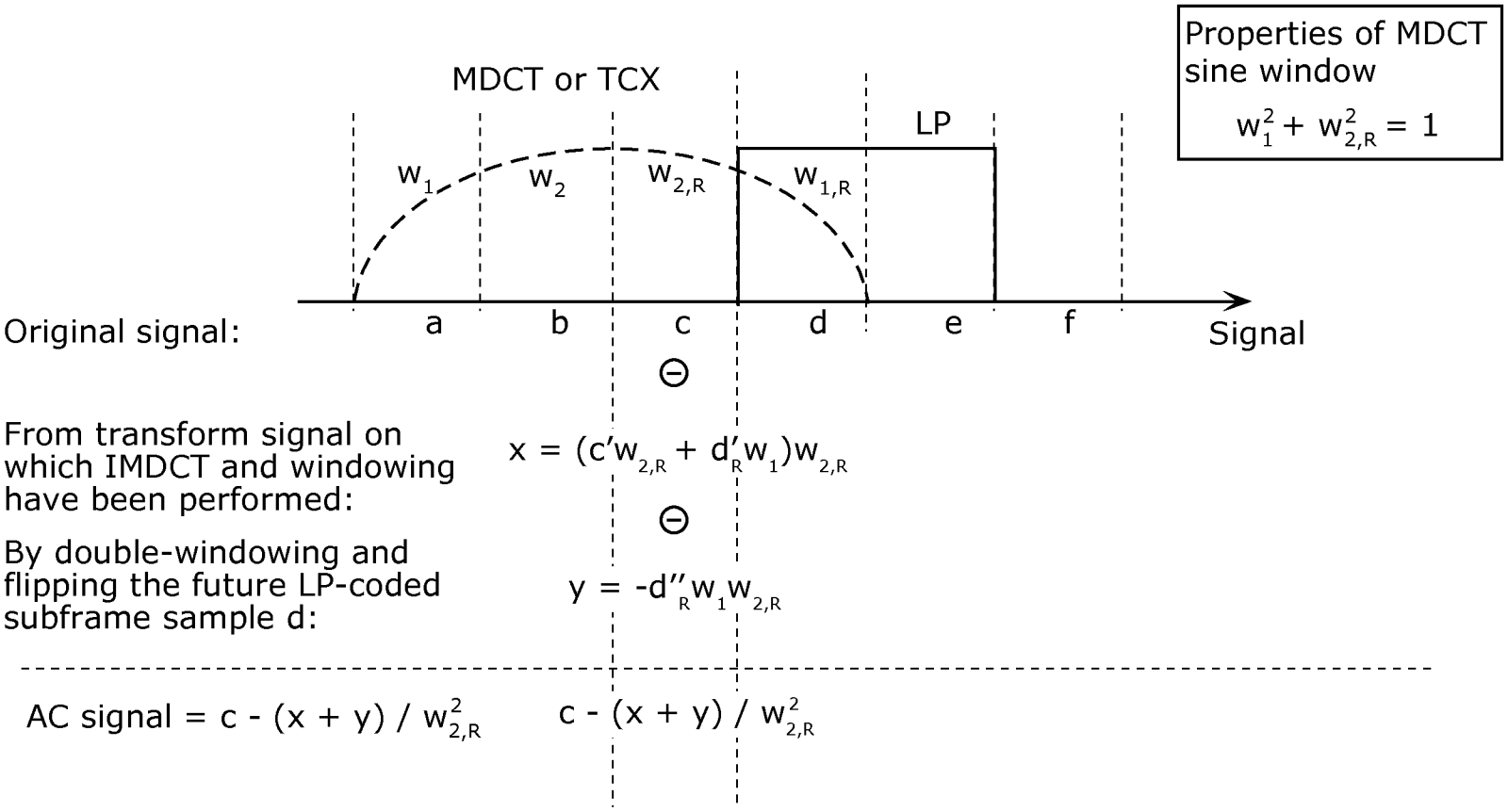
FIG. 9 is a diagram showing a second scheme for generating an AC signal used when transform coding is switched to LP coding.

FIG. 9 is a diagram showing the second scheme for generating the AC signal used when transform coding is switched to LP coding. To be more specific, the second AC candidate generator 701 generates the AC candidate (AC2) according to Expression 20 below.

[Math. 28]

$$AC2=c-(x+y)/w_{2,R}^{2} \quad \text{Expression 20}$$

Here, "x" (Expression 14) and "y" (Expression 15) are substituted into Expression 20 for expansion. Then, suppose that the following is assumed.

[Math. 29]

$$d'\approx d''$$

In this case, AC2 is approximated as shown by Expression 21 below

[Math. 30]

$$AC2\approx c-c' \quad \text{Expression 21}$$

Again, it is highly possible that AC2 is a signal that is more bit-efficient to be coded than AC. Particularly in the case where the bit efficiency is higher, the original signal c and the decoded signal c' are more likely to be similar in waveform.

Next, a method used by the AC candidate selector 702 to select the AC signal is described.

The simplest selection method for the AC candidate selector 702 is achieved by passing both AC and AC2 through the quantizer 414 and then selecting the AC candidate that requires fewer bits (a smaller amount of data) to code.

It should be noted that the method for selecting the AC candidate is not limited to this method and that a different method may be employed.

For example, when the frame size of the flame included in the first narrowband signal is larger than a predetermined size, the AC candidate selector 702 (the AC signal generation unit 413) may select the first scheme. Then, when the frame size of the frame included in the first narrowband signal is smaller than or equal to the predetermined size (such as when the amount of data to code this frame is small), the AC candidate selector 702 (the AC signal generation unit 413) may select the second scheme.

As mentioned above, AC2 is useful when the frame size is small. Therefore, with such a configuration, a low-bit-rate efficient encoder can be implemented.

Moreover, for example, the AC signal generation unit 413 may generate the AC signal according to the first scheme, and select the first scheme when the amount of coded data obtained as a result of the quantization performed by the quantizer on the AC signal generated according to the first scheme is smaller than a predetermined threshold.

With this configuration, where the amount of coded data of the AC signal generated by the first scheme is small enough, the AC signal does not need to be generated by the second scheme. Thus, the throughput for the AC signal generation can be reduced.

Moreover, when the amount of coded data obtained as a result of the quantization performed by the quantizer 414 on the AC signal generated according to the first scheme is larger than or equal to the predetermined threshold, the AC signal generation unit 413 further generates the AC signal according to the second scheme. Then, as a result, the AC signal generation unit 413 may output either the AC signal generated by the first scheme or the AC signal generated by the second scheme that has the smaller amount of coded data after the quantization by the quantizer 414.

With this configuration, while the throughput for the AC signal generation is reduced, the AC signal is generated according to the scheme that is adaptively selected. As a result, the low-bit-rate efficient encoder can be implemented.

It should be noted that the sound signal hybrid encoder in Embodiment 1 may have any configuration as long as at least a lapped frequency domain transform encoder (an LFD encoder such as an MDCT encoder or a TCX encoder) and a linear prediction encoder (an LP encoder). For example, the sound signal hybrid encoder in Embodiment 1 may be implemented as an encoder that includes only a TCX encoder and an LP encoder. Moreover, the bandwidth extension tool and the multichannel extension tool in Embodiment 1 are arbitrary low-bit-rate tools and are not required structural elements. The sound signal hybrid encoder in Embodiment 1 may be implemented as an encoder that has none of the subsets of these tools or none of these tools.

Embodiment 1 has described that, as an example, the AC signal generation unit 413 generates the AC signal according to the scheme selected from the first scheme and the second scheme. However, the AC signal generation unit 413 may select one of three or more schemes. To be more specific, the AC signal generation unit 413 may generate and output the AC signal according to the scheme selected from among the schemes, and also output the AC flag indicating the selected scheme. In this case, any kind of AC flag may be used as long as one scheme out of the schemes is precisely indicated. To achieve this, the AC flag may be formed by a plurality of bits, for example.

As described thus far, the sound signal hybrid encoder in Embodiment 1 can adaptively select the AC signal that is bit-efficient to be coded. To be more specific, the sound signal hybrid encoder in Embodiment 1 can implement a low-bit-rate efficient encoder. Such a bit rate reduction effect is pronounced particularly in the case where codec switching is carried out rapidly and in the case of a low-delay encoder that requires a large number of bits for coding.

[Embodiment 2]

A sound signal hybrid decoder is described in Embodiment 2.

Figure 10:
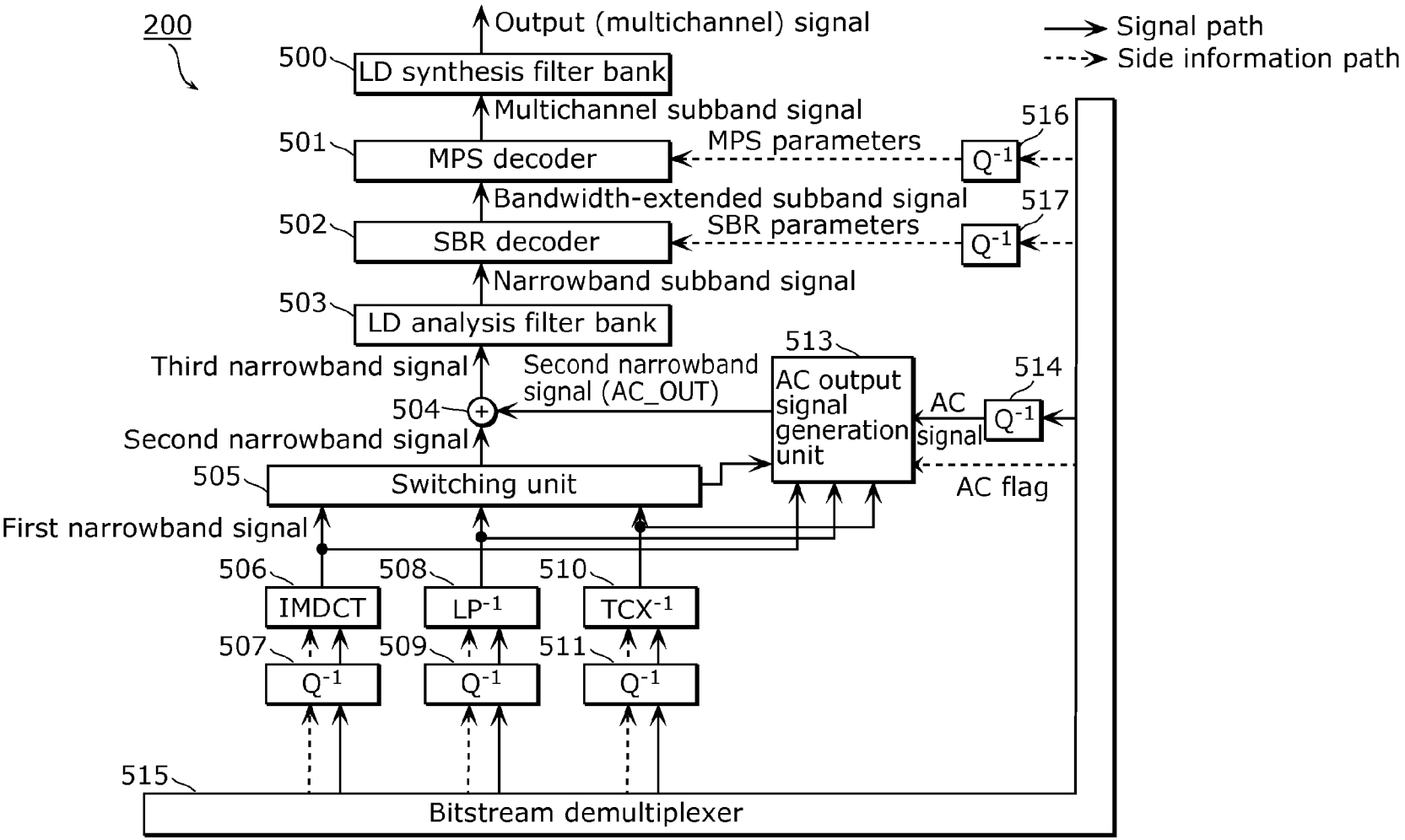
FIG. 10 is a block diagram showing a configuration of a sound signal hybrid decoder in Embodiment 2.

FIG. 10 is a block diagram showing a configuration of the sound signal hybrid decoder in Embodiment 2.

A sound signal hybrid decoder 200 includes an LD analysis filter bank 503, an LD synthesis filter bank 500, an MPS decoder 501, an SBR decoder 502, and a switching unit 505.

Moreover, the sound signal hybrid encoder 200 includes an audio decoder 506 including an IMDCT filter bank (simply referred to as the "IMDCT decoder 506" hereafter), an LP decoder 508, a TCX decoder 510, inverse-quantizers 507, 509, 511, 514, 516, and 517, a bitstream demultiplexer 515, and an AC output signal generation unit 513.

On the basis of a core coder indicator of the bitstream, the bitstream demultiplexer 515 selects one of the IMDCT decoder 506, the LP decoder 508, and the TCX decoder 510, and also selects one of the inverse quantizers 507, 509, and 511 corresponding to the selected decoder. The bitstream demultiplexer 515 performs inverse quantization on the bitstream data using the selected inverse quantizer and decodes the bitstream data using the selected decoder. Outputs from the inverse quantizers 507, 509, and 511 are inputted into the IMDCT decoder 506, the LP decoder 508, and the TCX decoder 510, respectively, which further transform the outputs into the time domain to generate the first narrowband signals. It should be noted that, in the following description, each of the IMDCT decoder 506 and the TCX decoder 510 may also be referred to as the inverse lapped frequency domain (ILFD) decoder.

The switching unit 505 firstly aligns the frames of the first narrowband signal according to time relations with past samples (i.e., according to the order in which coding is performed). In the case where the frame has been decoded by the IMDCT decoder 506, the switching unit 505 adds an overlap obtained by performing windowing, to the current frame to be decoded. A window that is the same as the window used by the encoder as shown in FIG. 5 is used. The window shown in FIG. 5 has the short overlap region to implement a low delay.

When codec switching is performed by the switching unit 505, aliasing components around the frame boundaries of the AC target frame (also referred to as the "switching frame") correspond to the signals shown in FIG. 2 and FIG. 3. Moreover, the switching unit 505 generates the second narrowband signal.

The inverse quantization 514 performs inverse quantization on the AC signal included in the bitstream. The AC flag included in the bitstream determines the subsequent processing method for the AC signal such as generation of an additional aliasing cancellation component using a past narrowband signal. The AC output signal generation unit 513 generates an AC_out signal (AC output signal) by summing the AC signal that has been inverse-quantized according to the AC flag and the AC components (such as x, y, and z) generated by the switching unit 505.

An adder 504 (addition unit) adds the AC_out signal to the second narrowband signals which have been aligned by the switching unit 505 and to which the overlap regions have been added. As a result, the aliasing components at the frame boundaries of the AC target frame are cancelled. The signal obtained as a result of cancellation of the aliasing components is referred to as a third narrowband signal.

The LD analysis filter bank 503 processes the third narrowband signal to generate a narrowband subband signal expressed by a hybrid time-frequency representation. As a specific choice for the LD filter bank, the low-delay QMF filter bank disclosed in Non Patent Literature 2 can be used for instance. However, the choice is not intended to be limiting.

The SBR decoder 502 (bandwidth extension decoding unit) extends the narrowband subband signal into a higher frequency domain. The extension method is either: a "patch-up" method whereby a low frequency band is copied to a higher frequency band; and a "stretch-up" method whereby the harmonics of the low frequency band are stretched on the basis of the principle of a phase vocoder. The characteristics of the extended (synthesized) high frequency region, particularly the energy, noise floor, and tone quality, are adjusted according to the SBR parameters inverse-quantized by the inverse quantizer 517. As a result, the bandwidth-extended subband signal is generated.

The MPS decoder 501 (multichannel extension decoding unit) generates a multichannel subband signal from the bandwidth-extended subband signal using the MPS parameters inverse-quantized by the inverse quantizer 516. For example, the MPS decoder 501 mixes an uncorrelated signal and the downmix signal according to the interchannel correlation parameters. Moreover, the MPS decoder 501 adjusts the amplitude and phase of the mixed signal on the basis of the interchannel level difference parameters and the interchannel phase difference parameters to generate the multichannel subband signal.

The LD synthesis filter bank 500 transforms the multichannel subband signal from the hybrid time-frequency domain back into the time domain, and outputs the time-domain multichannel signal.

The following is a detailed description on a configuration and an operation of the AC output signal generation unit 513. Here, this operation is a characteristic operation of the sound signal hybrid decoder 200 in Embodiment 2.

Figure 11:
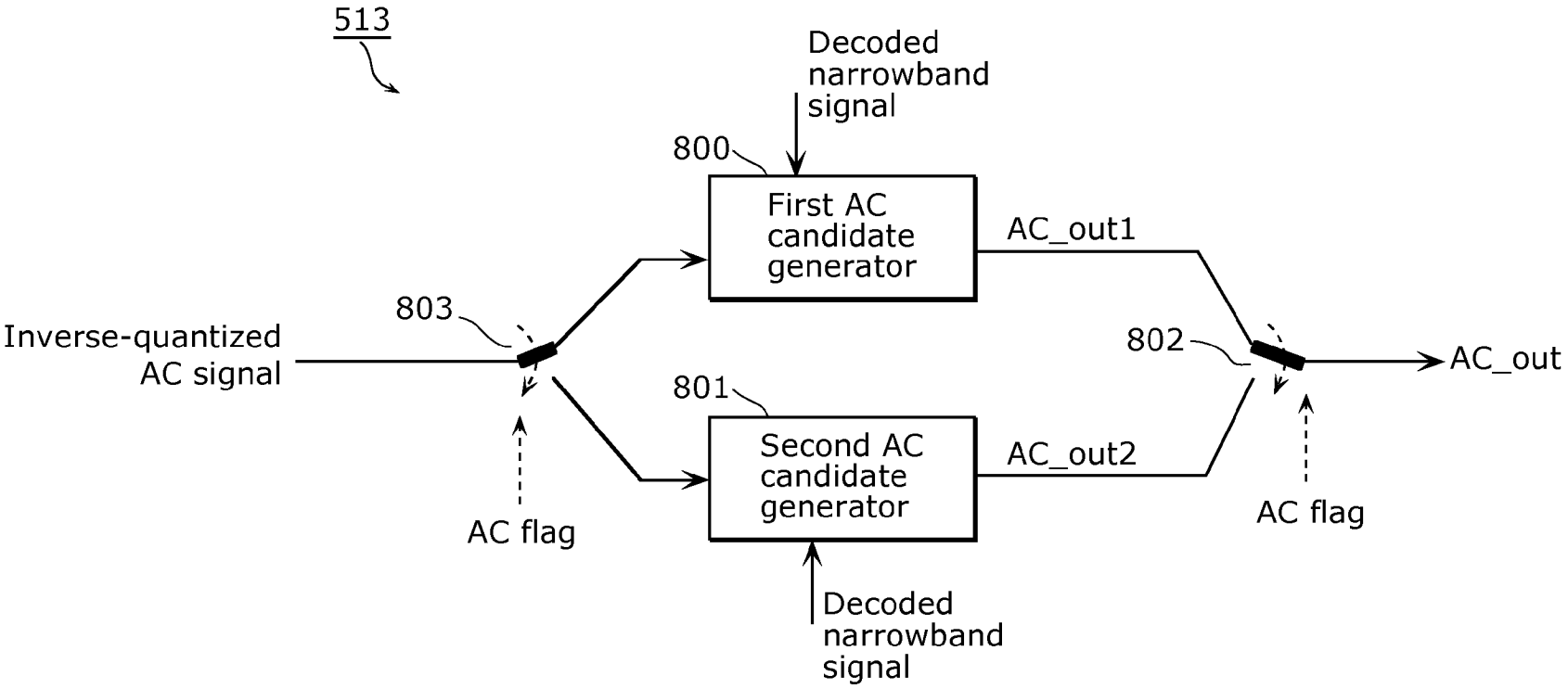
FIG. 11 is a block diagram showing an example of a configuration of an AC output signal generation unit.

FIG. 11 is a block diagram showing an example of the configuration of the AC output signal generation unit 513.

As shown in FIG. 11, the AC output signal generation unit 513 includes a first AC candidate generator 800, a second AC candidate generator 801, and AC candidate selectors 802 and 803.

Each of the first AC candidate generator 800 and the second AC candidate generator 801 calculates the AC candidate (AC output signal, i.e., AC_out), by using the inverse-quantized AC signal and the decoded narrowband signal. Each of the AC candidate selectors 802 and 803 selects either the first AC candidate generator 800 or the second AC candidate generator 801 for aliasing cancellation, according to the AC flag.

Figure 12:
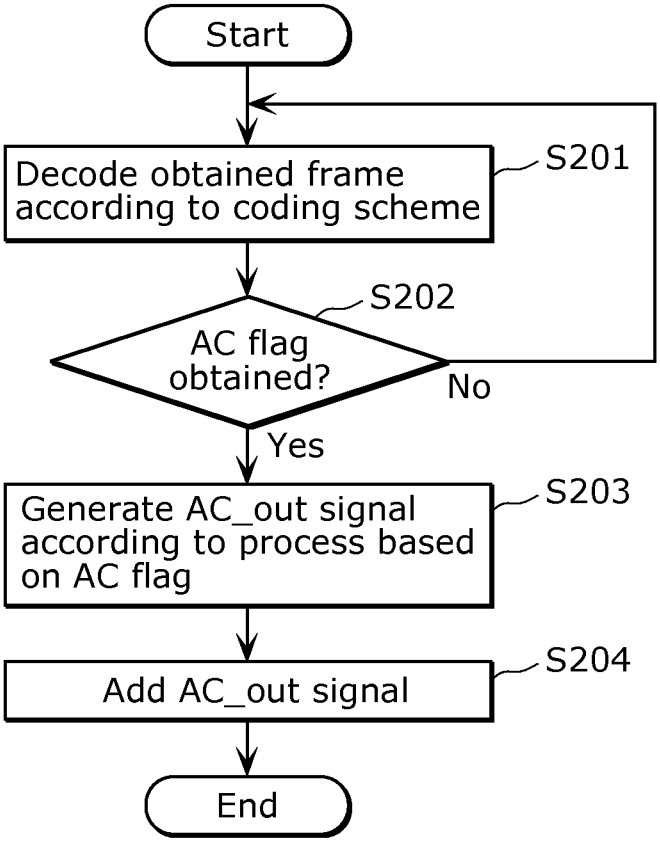
FIG. 12 is a flowchart showing an example of an operation performed by the AC output signal generation unit.

FIG. 12 is a flowchart showing an example of the operation performed by the AC output signal generation unit 513.

As described above, in the sound signal hybrid decoder 200, the obtained frame is decoded according to the coding scheme corresponding to this frame (S201 and No in S202).

When obtaining the AC flag (Yes in S202), the AC output signal generation unit 513 performs the process according to the AC flag to generate the AC_out signal (S203).

To be more specific, each of the AC candidate selectors 802 and 803 selects the AC candidate generator indicated by the AC flag. When the AC flag indicates the first scheme, each of the AC candidate selectors 802 and 803 selects the first AC candidate generator 800. When the AC flag indicates the second scheme, each of the AC candidate selectors 802 and 803 selects the second AC candidate generator 801.

After this, the AC output signal generation unit 513 (the AC candidate selectors 802 and 803) generates the AC_out signal using the selected AC candidate generator. In other words, the AC output signal generation unit 513 causes the selected AC candidate generator to generate the AC_out signal. To be more specific, the first AC candidate generator 800 generates a first AC_out signal, and the second AC candidate generator 801 generates a second AC_out signal.

Finally, the adder 504 adds the AC_out signal outputted from the AC output signal generation unit 513 to the second narrowband signal outputted from the switching unit 505, for aliasing cancellation (S204).

Next, the method for generating the AC_out signal is described in detail. In the following, the generation method (calculation method) of the AC_out signal that corresponds to the example described in Embodiment 1 is described.

However, it should be noted that the generation method of the AC_out signal is not limited to such a specific example and that any different method may be employed.

Firstly, the case where the coding scheme is switched from LP coding to transform coding (MDCT/TCX) is described with reference to FIG. 2 mentioned above. The first AC candidate generator 800 calculates the first AC_out signal as follows.

[Math. 31]

$$AC_out1=AC+y+z \quad \text{Expression 22}$$

The second AC candidate generator 801 calculates the second AC_out signal as follows.

[Math. 32]

$$AC_out2=AC+(1/w_2^2-1)x+y/w_2^2 \quad \text{Expression 23}$$

Here, "x", "y", and "z" are narrowband signals windowed as follows. More specifically, x is the signal on which the switching unit 505 performs time alignment and windowing. Moreover, y is the signal of the decoded preceding LP frame obtained by double-windowing and flipping by the switching unit 505, and corresponds to Expression 10. Furthermore, z is the ZIR of the preceding LP frame that is windowed by the switching unit 505, and corresponds to Expression 11.

Similarly, the case where the coding scheme is switched from transform coding (MDCT/TCX) to LP coding is described with reference to FIG. 3. The first AC candidate generator 800 calculates the first AC_out signal as follows.

[Math. 33]

$$AC_out1=AC+y \quad \text{Expression 24}$$

The second AC candidate generator 801 calculates the second AC_out signal as follows.

[Math. 34]

$$AC_out2=AC+(1/w_{2,R}^2-1)x+y/w_{2,R}^2 \quad \text{Expression 25}$$

Here, x is the signal on which the switching unit 505 performs time alignment and windowing. Moreover, y is the signal of the decoded subsequent LP frame obtained by double-windowing and flipping by the switching unit 505, and corresponds to Expression 15.

As described thus far, in the sound signal hybrid decoder 200 in Embodiment 2, each of the AC candidate selector 802 and 803 activates the first AC candidate generator 800 or the second AC candidate generator 801 according to the AC flag and outputs AC_out1 or AC_out2. As a result, the sound signal hybrid decoder 200 can cancel the aliasing components of the signals coded by the sound signal hybrid encoder in Embodiment 1.

It should be noted that the sound signal hybrid decoder in Embodiment 2 may have any configuration as long as at least a lapped frequency domain transform decoder (an ILFD decoder such as an MDCT decoder or a TCX decoder) and a linear prediction decoder (an LP decoder). For example, the sound signal hybrid decoder in Embodiment 2 may be implemented as a decoder that includes only a TCX decoder and an LP decoder. Moreover, the bandwidth extension tool and the multichannel extension tool in Embodiment 2 are arbitrary low-bit-rate tools and are not required structural elements. The sound signal hybrid decoder in Embodiment 2 may be implemented as a decoder that has none of the subsets of these tools or none of these tools.

As described thus far, the sound signal hybrid decoder in Embodiment 2 can appropriately decode the signal coded by the sound signal hybrid encoder in Embodiment 1, according to the AC flag. The sound signal hybrid encoder in Embodiment 1 adaptively selects the AC signal that is bit-efficient to be coded. Accordingly, the sound signal hybrid decoder in Embodiment 2 can implement a low-bit-rate efficient decoder.

Such a bit rate reduction effect is pronounced particularly in the case where codec switching is carried out rapidly and in the case of a low-delay encoder that requires a large number of bits for coding.

[Variations]

Although the present invention has been described by way of Embodiments above, it should be obvious that the present invention is not limited to Embodiments described above. Therefore, the followings are also included in the present invention.

(1) Each of the above-described apparatuses may be implemented as a computer system configured with, specifically speaking, a microprocessor, a ROM, a RAM, a hard disk unit, a display unit, a keyboard, a mouse, and so forth. The RAM or the hard disk unit stores a computer program. The microprocessor operates according to the computer program and, as a result, each function of the apparatus is carried out. Here, note that the computer program includes a plurality of instruction codes indicating instructions to be given to the computer to achieve a specific function.

(2) Some or all of the structural elements included in each of the above-described apparatuses may be implemented as a single system Large Scale Integration (LSI). The system LSI is a super multifunctional LSI manufactured by integrating a plurality of structural elements onto a signal chip. To be more specific, the system LSI is a computer system configured with a microprocessor, a ROM, a RAM, and so forth. The ROM stores a computer program. The microprocessor loads the computer program from the ROM into the RAM and performs calculations and the like according to the loaded computer program. As a result, the system LSI carries out the function.

(3) Some or all of the structural elements included in each of the above-described apparatuses may be implemented as an IC card or a standalone module that can be inserted into and removed from the corresponding apparatus. The IC card or the module is a computer system configured with a microprocessor, a ROM, a RAM, and so forth. The IC card or the module may include the aforementioned super multifunctional LSI. The microprocessor operates according to the computer program and, as a result, a function of the IC card or the module is carried out. The IC card or the module may be tamper resistant.

(4) The present invention may be the methods described above. Each of the methods may be a computer program implemented by a computer. Moreover, the present invention may be implemented as a digital signal of the computer program.

Moreover, the present invention may be implemented as the aforementioned computer program or digital signal recorded on a computer-readable recording medium, such as a flexible disk, a hard disk, a CD-ROM, an MO, a DVD, a DVD-ROM, a DVD-RAM, a Blu-ray Disc (BD) (registered trademark), or a semiconductor memory. Also, the present invention may be implemented as the digital signal recorded on such a recording medium.

Furthermore, the present invention may be implemented as the aforementioned computer program or digital signal transmitted via, for example, a telecommunication line, a wireless or wired communication line, a network represented by the Internet, and data broadcasting.

Moreover, the present invention may be implemented as a computer system including a microprocessor and a memory. The memory may store the aforementioned computer program and the microprocessor may operate according to the computer program.

Moreover, by transferring the recording medium having the aforementioned program or digital signal recorded thereon or by transferring the aforementioned program or digital signal via the aforementioned network or the like, the present invention may be implemented by a different independent computer system.

(5) Embodiments described above and variations may be combined.

It should be noted that the present invention is not limited to the embodiments descried above and the variations thereof. Other embodiments implemented on the above embodiments or variations through various changes and modifications conceived by a person of ordinary skill in the art or through a combination of the structural elements in different embodiments and variations described above may be included in the scope in an aspect or aspects according to the present invention, unless such changes, modifications, and combination depart from the scope of the present invention.

INDUSTRIAL APPLICABILITY

The present invention is used for purposes that relate to coding of a signal including speech content or music content, such as an audio book, a broadcasting system, a portable media device, a mobile communication terminal (a smart phone or a tablet computer, for example), a video conferencing device, and a networked music performance.

REFERENCE SIGNS LIST

100 Sound signal hybrid encoder
200 Sound signal hybrid decoder
400, 503 LD analysis filter bank
401 MPS encoder
402 SBR encoder
403, 500 LD synthesis filter bank
404 Signal analysis unit
405, 505 Switching unit
406 MDCT encoder
407, 409, 411, 414, 416, 417 Quantizer
408 LP encoder
410 TCX encoder
412 Local decoder
413 AC signal generation unit
415 bitstream multiplexer
501 MPS decoder
502 SBR decoder
504 Adder (addition unit)
506 IMDCT decoder
507, 509, 511, 514, 516, 517 Inverse quantizer
508 LP decoder
510 TCX decoder
513 AC output signal generation unit
515 bitstream demultiplexer
700, 800 First AC candidate generator
701, 801 Second AC candidate generator
702, 802, 803 AC candidate selector

The invention claimed is:

1. A sound signal hybrid encoder comprising:

a processor;

a signal analysis unit configured to analyze characteristics of a sound signal to determine a scheme for encoding a frame included in the sound signal;

a lapped frequency domain (LFD) encoder which encodes a frame included in the sound signal by performing an LFD transform on the frame, to generate an LFD frame;

a linear prediction (LP) encoder which encodes a frame included in the sound signal by calculating and using linear prediction coefficients of the frame, to generate an LP frame;

a switching unit configured to switch, for frame encoding, between the LFD encoder and the LP encoder, according to a result of the determination by the signal analysis unit;

a local decoder which generates a locally-decoded signal including (1) a signal obtained by decoding at least a part of an aliasing cancellation target frame that is the LFD frame adjacent to the LP frame according to switching control by the switching unit and (2) a signal obtained by decoding at least a part of the LP frame adjacent to the aliasing cancellation target frame; and an aliasing cancellation signal generation unit configured to, using the processor, (i) generate, using the sound signal and the locally-decoded signal, an aliasing cancellation signal used for cancelling aliasing caused when the aliasing cancellation target frame is decoded and (ii) output the generated aliasing cancellation signal, wherein, when the aliasing cancellation target frame is immediately after the LP frame or when the aliasing cancellation target frame is immediately before the LP frame, the aliasing cancellation signal generation unit is configured to (1) generate the aliasing cancellation signal according to a scheme selected from among a plurality of schemes and output the generated aliasing cancellation signal and (2) output an aliasing cancellation flag indicating the selected scheme, the aliasing cancellation signal generation unit is configured to generate the aliasing cancellation signal according to the scheme selected from a first scheme and a second scheme that is different from the first scheme, and output the generated aliasing cancellation signal, the first scheme is a scheme that is standardized by unified speech and audio coding (USAC), and has a higher priority given to aliasing cancellation than in the second scheme, and the second scheme is a scheme in which (i) a number of quantized bits is less than a number of quantized bits in the first scheme or (ii) a degree of filter coefficients is less than a degree of filter coefficients in the first scheme.

2. The sound signal hybrid encoder according to claim 1, further comprising a quantizer which quantizes the aliasing cancellation signal, wherein the aliasing cancellation signal generation unit is configured to generate the aliasing cancellation signal according to each of the first scheme and the second scheme and output the aliasing cancellation signal, out of the two generated aliasing cancellation signals, that is smaller in an amount of coded data obtained by the quantization by the quantizer.

3. The sound signal hybrid encoder according to claim 1, wherein, when the aliasing cancellation target frame is immediately after the LP frame, the first scheme generates the aliasing cancellation signal using a zero input response obtained by performing windowing on the LP frame immediately preceding the aliasing cancellation target frame, and the second scheme generates the aliasing cancellation signal without using the zero input response.

4. The sound signal hybrid encoder according to claim 1, wherein the aliasing cancellation signal generation unit is configured to select the first scheme when a frame size of the sound signal is larger than a predetermined size, and select the second scheme when the frame size of the sound signal is smaller than or equal to the predetermined size.

5. The sound signal hybrid encoder according to claim 1, further comprising a quantizer which quantizes the aliasing cancellation signal, wherein the aliasing cancellation signal generation unit is configured to generate the aliasing cancellation signal according to the first scheme, and select the first scheme when the amount of coded data obtained by the quantization performed by the quantizer on the aliasing cancellation signal generated according to the first scheme is smaller than a predetermined threshold, and when the amount of coded data obtained by the quantization performed by the quantizer on the aliasing cancellation signal generated according to the first scheme is larger than or equal to the predetermined threshold, the aliasing cancellation signal generation unit is configured to further generate the aliasing cancellation signal according to the second scheme and output the aliasing cancellation signal, out of the aliasing cancellation signals generated according to the first and second schemes, that is smaller in the amount of coded data obtained by the quantization performed by the quantizer.

6. The sound signal hybrid encoder according to claim 1, wherein the aliasing cancellation signal generation unit further includes:

a first aliasing cancellation candidate generator which generates the aliasing cancellation signal according to the first scheme;

a second aliasing cancellation candidate generator which generates the aliasing cancellation signal according to the second scheme; and an aliasing cancellation candidate selector which (1) outputs the aliasing cancellation signal generated by the first aliasing cancellation candidate generator or the second aliasing cancellation candidate generator that is selected and (2) outputs the aliasing cancellation flag indicating whether the outputted aliasing cancellation signal is generated according to the first scheme or the second scheme.

7. The sound signal hybrid encoder according to claim 1, further comprising:

a low-delay (LD) analysis filter bank which generates an input subband signal by converting an input signal into a time-frequency domain representation;

a multichannel extension unit configured to generate a multichannel extension parameter and a downmix subband signal, from the input subband signal;

a bandwidth extension unit configured to generate a bandwidth extension parameter and a narrowband subband signal, from the downmix subband signal;

an LD synthesis filter bank which generates the sound signal by converting the narrowband subband signal from the time-frequency domain representation to a time domain representation;

a quantizer which quantizes the multichannel extension parameter, the bandwidth extension parameter, the outputted aliasing cancellation signal, the LFD frame, and the LP frame; and a bitstream multiplexer which multiplexes the signal quantized by the quantizer and the aliasing cancellation flag and transmits a result of the multiplexing.

8. The sound signal hybrid encoder according to claim 1, wherein the LFD encoder encodes the frame according to a transform coded excitation (TCX) scheme.

9. The sound signal hybrid encoder according to claim 1, wherein the LFD encoder encodes the frame according to a modified discrete cosine transform (MDCT), the switching unit is configured to perform windowing on the frame to be encoded by the LFD encoder, and a window used in the windowing monotonically increases or monotonically decreases in a period that is shorter than half of a length of the frame.

10. The sound signal hybrid encoder according to claim 1, wherein the second scheme is a scheme which is not standardized by the USAC.

11. A sound signal hybrid decoder which decodes a coded signal including an LFD frame coded by an LFD transform, an LP frame coded using linear prediction coefficients, and an aliasing cancellation signal used for cancelling aliasing of an aliasing cancellation target frame that is the LFD frame adjacent to the LP frame, the sound signal hybrid decoder comprising:

a processor;

an inverse lapped frequency domain (ILFD) decoder which decodes the LFD frame;

an LP decoder which decodes the LP frame;

a switching unit configured to output a first narrowband signal in which the LFD frame that is decoded by the ILFD decoder and windowed and the LP frame decoded by the LP decoder are aligned in order;

an aliasing cancellation output signal generation unit configured to, using the processor, (i) obtain an aliasing cancellation flag indicating a scheme used for generating the aliasing cancellation signal and (ii) generate, according to the scheme indicated by the aliasing cancellation flag, an aliasing cancellation output signal in which a signal outputted from the switching unit, the ILFD decoder, or the LP decoder is added to the aliasing cancellation signal; and an addition unit configured to output a second narrowband signal in which the aliasing cancellation output signal is added to a part corresponding to the aliasing cancellation target frame included in the first narrowband signal, wherein the scheme indicated by the aliasing cancellation flag includes a first scheme and a second scheme, the first scheme is a scheme that is standardized by USAC, and has a higher priority given to aliasing cancellation than in the second scheme, and the second scheme is a scheme in which (i) a number of quantized bits is less than a number of quantized bits in the first scheme or (ii) a degree of filter coefficients is less than a degree of filter coefficients in the first scheme.

12. The sound signal hybrid decoder according to claim 11, further comprising:

a bitstream demultiplexer which obtains the coded signal that is quantized and a bitstream including the aliasing cancellation flag;

an inverse quantizer which generates the coded signal by performing inverse quantization on the quantized coded signal;

an LD analysis filter bank which generates a narrowband subband signal by converting the third narrowband signal outputted from the addition unit into a time-frequency domain representation;

a bandwidth extension decoding unit configured to synthesize a high frequency signal to generate a bandwidth-extended subband signal, by applying a bandwidth extension parameter included in the coded signal generated by the inverse quantizer to the narrowband subband signal;

a multichannel extension decoding unit configured to generate a multichannel subband signal by applying a multichannel extension parameter included in the coded signal generated by the inverse quantizer to the bandwidth-extended subband signal; and an LD synthesis filter bank which generates a multichannel signal by converting the multichannel subband signal from the time-frequency domain representation to a time domain representation.

13. The sound signal hybrid decoder according to claim 11, wherein the aliasing cancellation signal is generated according to a first scheme or a second scheme that is different from the first scheme, and the aliasing cancellation output signal generation unit further includes:

a first aliasing cancellation candidate generator which generates the aliasing cancellation output signal corresponding to the aliasing cancellation signal generated according to the first scheme;

a second aliasing cancellation candidate generator which generates the aliasing cancellation output signal corresponding to the aliasing cancellation signal generated according to the second scheme; and an aliasing cancellation candidate selector which selects either one of the first aliasing cancellation candidate generator and the second aliasing cancellation candidate generator according to the aliasing cancellation flag, and causes the selected first or second aliasing cancellation candidate generator to generate the aliasing cancellation output signal.

14. A sound signal encoding method comprising:

analyzing characteristics of a sound signal to determine a scheme for encoding a frame included in the sound signal;

encoding a frame included in the sound signal by performing an LFD transform on the frame, to generate an LFD frame;

encoding a frame included in the sound signal by calculating and using linear prediction coefficients of the frame, to generate an LP frame;

switching between the encoding a frame by performing an LFD transform and the encoding a frame by calculating and using linear prediction coefficients, according to a result of the determination in the analyzing;

generating a locally-decoded signal including (1) a signal obtained by decoding at least a part of an aliasing cancellation target frame that is the LFD frame adjacent to the LP frame according to switching control by the switching and (2) a signal obtained by decoding at least a part of the LP frame adjacent to the aliasing cancellation target frame; and using a processor, generating, using the sound signal and the locally-decoded signal, an aliasing cancellation signal used for cancelling aliasing caused when the aliasing cancellation target frame is decoded, and outputting the generated aliasing cancellation signal, wherein, in the generating an aliasing cancellation signal, when the aliasing cancellation target frame is immediately after the LP frame or when the aliasing cancellation target frame is immediately before the LP frame, (1) the aliasing cancellation signal is generated according to a scheme selected from among a plurality of schemes and is outputted and (2) an aliasing cancellation flag indicating the selected scheme is outputted, the aliasing cancellation signal generation unit is configured to generate the aliasing cancellation signal according to the scheme selected from a first scheme and a second scheme that is different from the first scheme, and output the generated aliasing cancellation signal, the first scheme is a scheme that is standardized by USAC, and has a higher priority given to aliasing cancellation than in the second scheme, and the second scheme is a scheme in which (i) a number of quantized bits is less than a number of quantized bits in the first scheme or (ii) a degree of filter coefficients is less than a degree of filter coefficients in the first scheme.

15. A non-transitory computer-readable recording medium for use in a computer, the recording medium having a computer program recorded thereon for causing the computer to execute the sound signal encoding method according to claim 14.

16. An integrated circuit comprising:

a processor;

a signal analysis unit configured to analyze characteristics of a sound signal to determine a scheme for encoding a frame included in the sound signal;

an LFD encoder which encodes a frame included in the sound signal by performing an LFD transform on the frame, to generate an LFD frame;

an LP encoder which encodes a frame included in the sound signal by calculating and using linear prediction coefficients of the frame, to generate an LP frame;

a switching unit configured to switch, for frame encoding, between the LFD encoder and the LP encoder, according to a result of the determination by the signal analysis unit;

a local decoder which generates a locally-decoded signal including (1) a signal obtained by decoding at least a part of an aliasing cancellation target frame that is the LFD frame adjacent to the LP frame according to switching control by the switching unit and (2) a signal obtained by decoding at least a part of the LP frame adjacent to the aliasing cancellation target frame; and an aliasing cancellation signal generation unit configured to, using the processor, (i) generate, using the sound signal and the locally-decoded signal, an aliasing cancellation signal used for cancelling aliasing caused when the aliasing cancellation target frame is decoded and (ii) output the generated aliasing cancellation signal, wherein, when the aliasing cancellation target frame is immediately after the LP frame or when the aliasing cancellation target frame is immediately before the LP frame, the aliasing cancellation signal generation unit is configured to (1) generate the aliasing cancellation signal according to a scheme selected from among a plurality of schemes and output the generated aliasing cancellation signal and (2) output an aliasing cancellation flag indicating the selected scheme, the aliasing cancellation signal generation unit is configured to generate the aliasing cancellation signal according to the scheme selected from a first scheme and a second scheme that is different from the first scheme, and output the generated aliasing cancellation signal, the first scheme is a scheme standardized by USAC, and has a higher priority given to aliasing cancellation than in the second scheme, and the second scheme is a scheme in which (i) a number of quantized bits is less than a number of quantized bits in the first scheme or (ii) a degree of filter coefficients is less than a degree of filter coefficients in the first scheme.

17. A sound signal decoding method for decoding a coded signal including an LFD frame coded by an LFD transform, an LP frame coded using linear prediction coefficients, and an aliasing cancellation signal used for cancelling aliasing of an aliasing cancellation target frame that is the LFD frame adjacent to the LP frame, the sound signal decoding method comprising:

decoding the LFD frame;

decoding the LP frame;

outputting a first narrowband signal in which the LFD frame that is decoded in the decoding the LFD frame and is windowed and the LP frame decoded in the decoding the LP frame are aligned in order;

using a processor, (i) obtaining an aliasing cancellation flag indicating a scheme used for generating the aliasing cancellation signal and (ii) generating, according to the scheme indicated by the aliasing cancellation flag, an aliasing cancellation output signal in which a signal outputted in the outputting, the decoding the LFD frame, or the decoding the LP frame is added to the aliasing cancellation signal; and outputting a second narrowband signal in which the aliasing cancellation output signal is added to a part corresponding to the aliasing cancellation target frame included in the first narrowband signal, wherein the scheme indicated by the aliasing cancellation flag includes a first scheme and a second scheme, the first scheme is a scheme that is standardized by USAC, and has a higher priority given to aliasing cancellation than in the second scheme, and the second scheme is a scheme in which (i) a number of quantized bits is less than a number of quantized bits in the first scheme or (ii) a degree of filter coefficients is less than a degree of filter coefficients in the first scheme.

18. A non-transitory computer-readable recording medium for use in a computer, the recording medium having a computer program recorded thereon for causing the computer to execute the sound signal decoding method according to claim 17.

19. An integrated circuit which decodes a coded signal including an LFD frame coded by an LFD transform, an LP frame coded using linear prediction coefficients, and an aliasing cancellation signal used for cancelling aliasing of an aliasing cancellation target frame that is the LFD frame adjacent to the LP frame, the integrated circuit comprising:

a processor;

an ILFD decoder which decodes the LFD frame;

an LP decoder which decodes the LP frame;

a switching unit configured to output a first narrowband signal in which the LFD frame that is decoded by the ILFD decoder and windowed and the LP frame decoded by the LP decoder are aligned in order;

an aliasing cancellation output signal generation unit configured to, using the processor, (i) obtain an aliasing cancellation flag indicating a scheme used for generating the aliasing cancellation signal and (ii) generate, according to the scheme indicated by the aliasing cancellation flag, an aliasing cancellation output signal in which a signal outputted from the switching unit, the ILFD decoder, or the LP decoder is added to the aliasing cancellation signal; and an addition unit configured to output a second narrowband signal in which the aliasing cancellation output signal is added to a part corresponding to the aliasing cancellation target frame included in the first narrowband signal, wherein the scheme indicated by the aliasing cancellation flag includes a first scheme and a second scheme, the first scheme is a scheme that is standardized by USAC, and has a higher priority given to aliasing cancellation than in the second scheme, and the second scheme is a scheme in which (i) a number of quantized bits is less than a number of quantized bits in the first scheme or (ii) a degree of filter coefficients is less than a degree of filter coefficients in the first scheme.

* * * * *